US012655551B2

(12) United States Patent
Manna et al.

(10) Patent No.: US 12,655,551 B2
(45) Date of Patent: Jun. 16, 2026

(54) INTERLOCK KNIT TEXTILES AND METHODS OF MAKING AND USING SAME

(71) Applicant: LULULEMON ATHLETICA CANADA INC., Vancouver (CA)

(72) Inventors: Rovin Manna, Taipei (TW); Yogendra V. Dandapure, Vancouver (CA); Mingjun Cheng, Shanghai (CN)

(73) Assignee: LULULEMON ATHLETICA CANADA INC., Vancouver (CA)

( * ) Notice: Subject to any disclaimer, the term of this patent is extended or adjusted under 35 U.S.C. 154(b) by 0 days.

(21) Appl. No.: 19/254,669

(22) Filed: Jun. 30, 2025

(65) Prior Publication Data

US 2026/0035842 A1 Feb. 5, 2026

Related U.S. Application Data

(63) Continuation-in-part of application No. 18/791,945, filed on Aug. 1, 2024, now abandoned.

(51) Int. Cl.

| | |
|---|---|
| ***D04B 1/18*** | (2006.01) |
| ***D04B 1/24*** | (2006.01) |
| ***D04B 9/08*** | (2006.01) |

(52) U.S. Cl.

CPC ..... *D04B 1/18* (2013.01); *D04B 1/24* (2013.01); *D04B 9/08* (2013.01); *D10B 2401/061* (2013.01); *D10B 2403/0114* (2013.01)

(58) Field of Classification Search

CPC . D04B 1/08; D04B 1/12; D04B 1/123; D04B 1/14; D04B 1/16; D04B 1/18; D04B 1/24; D04B 7/16; D04B 9/08; D04B 9/16; D04B 9/38

See application file for complete search history.

(56) References Cited

U.S. PATENT DOCUMENTS 3,971,234 A * 7/1976 Taylor ..... D04B 1/126 66/196
4,062,204 A * 12/1977 Segundo ..... D04B 15/80 66/196
5,687,587 A * 11/1997 Michel ..... D04B 1/18 66/196

(Continued)

FOREIGN PATENT DOCUMENTS

KR 20040009825 A 1/2004
WO 2023034102 A1 3/2023

OTHER PUBLICATIONS

Extended European Search Report issued Jan. 7, 2026 in European Patent Application No. 25191953.6.

*Primary Examiner* — Danny Worrell
(74) *Attorney, Agent, or Firm* — Plumsea Law Group, LLC

(57) ABSTRACT

Interlock knit textiles and methods of forming and using interlock knit textiles are described. Three structural properties have been found to contribute to improved stretch properties in interlock knits. The three structural properties include the use of a unique knitted loop shape, the use of fine filament yarns, and the use of elasticated yarns having lower hysteresis than conventional elastane. The described interlock knit textiles can include one, two or all three of these structural properties. The improved stretch properties can include values for percent elongation or modulus in the length direction which are close to or the same as their values in the width direction.

20 Claims, 13 Drawing Sheets

(56) References Cited

U.S. PATENT DOCUMENTS

| | | | | |
|---|---|---|---|---|
| 7,240,522 | B2 * | 7/2007 | Kondou | D04B 15/48 66/195 |
| 7,867,056 | B2 * | 1/2011 | Scheininger | D04B 1/246 450/74 |
| 8,959,959 | B1 * | 2/2015 | Podhajny | A43B 23/042 36/47 |
| 9,551,095 | B2 * | 1/2017 | Lee | D04B 15/367 |
| 9,689,092 | B2 * | 6/2017 | Liao | D04B 1/18 |
| 11,739,449 | B2 * | 8/2023 | Hanamura | D04B 1/24 66/202 |
| 2004/0237599 | A1 * | 12/2004 | Kondou | D04B 15/50 66/202 |
| 2006/0021387 | A1 * | 2/2006 | Chuang | D04B 1/18 66/8 |
| 2008/0032580 | A1 * | 2/2008 | Fukuoka | D04B 1/18 28/103 |
| 2016/0040328 | A1 * | 2/2016 | Yoshida | D04B 1/18 66/193 |
| 2016/0138203 | A1 * | 5/2016 | Akita | D04B 1/18 66/202 |
| 2016/0265146 | A1 * | 9/2016 | Liao | D04B 1/18 |
| 2021/0189615 | A1 * | 6/2021 | Yanagi | D04B 1/102 |
| 2021/0254244 | A1 * | 8/2021 | Lui | D04B 1/04 |
| 2022/0081810 | A1 * | 3/2022 | Kashima | D04B 1/12 |
| 2022/0282409 | A1 * | 9/2022 | Hendry | D04B 1/126 |
| 2024/0376646 | A1 * | 11/2024 | Hietpas | D04B 1/12 |

* cited by examiner

INTERLOCK KNIT TEXTILES AND METHODS OF MAKING AND USING SAME

CROSS-REFERENCE TO RELATED APPLICATION

This application is a continuation-in-part of and claims benefit to U.S. patent application Ser. No. 18/791,945, filed on Aug. 1, 2024 and titled "Method of Knitting an Unrestricted Interlock Textile," the disclosure of which application is incorporated by reference herein in its entirety.

FIELD

The present aspects relate generally to interlock knit textiles, articles incorporating the interlock knit textiles, and to methods of making and using the interlock knit textiles, including articles of apparel incorporating the interlock knit textiles.

BACKGROUND

Interlock knit textiles are a type of double-knit textile which can be made using two needle beds in a weft knitting machine. In interlock knit textiles, knitted loops on the face side of the textile interlock with knitted loops on the back side of the textile. An interlock knit structure is a type of double jersey knit structure and produces textiles in which both the face and back sides of the textile have very similar or identical appearances. Interlock knit structures are known to produce thick, stable, and durable textiles having smooth surfaces on both sides allowing the textile to be reversible in some cases. Interlock knit textiles generally lay flat and do not tend to roll or curl at the edges, which provides many advantages when using pieces cut from a larger portion of the textile. These characteristics of interlock knit textiles make them useful across a wide variety of industries, including but not limited to apparel including sportswear, home goods, medical and healthcare products, and many other applications. However, in conventional interlock knit textiles, the stretch properties such as elongation and modulus are significantly different depending upon the direction or axis along which the textile is stretched. When a conventional interlock textile is stretched in the direction parallel with the courses of the knit structure and perpendicular to the wales of the knit structure (i.e., stretched in the length direction of the textile as it comes off the knitting machine), the wales of the interlock knit structure limit the amount to which the textile can stretch in the length direction to a far greater extent than the courses in the interlock knit structure limit stretch when the textile is stretched in the direction parallel to the wales (i.e., stretched in the width direction of the textile as it comes off the knitting machine). This results in conventional interlock knit textiles being considered to have "unbalanced" stretch properties as they have less stretch in their length direction than in their width direction. The unbalanced stretch properties of conventional interlock knit textiles limits their usefulness. Other types of knit structures, such as tuck stitch knit structures, do not constrain or limit stretch in one direction to as great a degree, and so result in knit textiles having more "balanced" or "square" stretch properties, meaning that the stretch properties in the width direction are close to or the same as the stretch properties in the length direction.

SUMMARY

New interlock knit structures, new interlock knit textiles, articles comprising the new interlock knit textiles, as well as new methods of manufacturing and using the new interlock knit textiles have been developed and are disclosed herein. Three structural properties have been identified which can improve the stretch properties of interlock knit textiles. These disclosed structural properties can be used separately or in combination to produce the disclosed interlock knit textiles which exhibit improved textile stretch properties as compared to conventional interlock knit textiles. In some aspects, the disclosed interlock knit textiles exhibit improved directional stretch properties in their length direction, resulting in the disclosed interlock knit textiles having more balanced textile stretch properties as compared to conventional interlock knit textiles.

The disclosed interlock knit textiles comprise a first yarn and a second yarn knitted together in an interlock knit structure. The second yarn can be an elasticated yarn, such as a yarn comprising or consisting of one or more elastane filaments. In one aspect, the first yarn is a non-elasticated yarn, and is a multifilament yarn, such as a yarn comprising or consisting of polyester filaments, nylon filaments, or regenerated cellulose filaments. The first yarn and the second yarn can be plated together (i.e., brought together and knitted on the same needles at the same time) as part of the knitting process. The disclosed interlock knit textiles include at least two courses having the disclosed interlock knit structure which includes the first and second yarn knitted together. The disclosed interlock knit textiles have been found to exhibit improved directional stretch properties as compared to conventional interlock knit textiles. Three structural properties have been found to contribute to the improved directional stretch properties. A first structural property is the presence of a unique knitted loop shape in a plurality of knitted loops in the disclosed interlock knit textile. A second structural property is the use of a first yarn comprising or consisting of fine filaments in the interlock knit structure of the disclosed interlock knit textile. A third structural property is the use of a specific type of elastomeric material or yarn for the second yarn, such as an elasticated yarn having improved stretchability and/or recovery as compared to equivalent conventional elastane yarns. In one aspect, the disclosed interlock knit textiles include at least one of these three structural properties. In another aspect, the disclosed interlock knit textiles include at least two of these three structural properties. In yet another aspect, the disclosed interlock knit textiles includes all three of these structural properties. Specifically, the disclosed interlock knit textiles include at least one structural property chosen from a) a plurality of knitted loops in the interlock knit structure have an average loop distance ratio of less than 0.85, b) the first yarn comprises or consists of filaments having an average denier per filament (dpf) of 0.8 or less, and c) the second yarn comprises or consists of an elastomeric material having a lower hysteresis than conventional elastane. The disclosed interlock knit textiles have been found to provide advantages, such as when they are incorporated in articles including in articles of apparel.

In one aspect, the disclosed interlock knit textiles can include the structural property of a plurality of the knitted loops having a unique knitted loop shape that is wider and shorter as compared to the loop shape of the knitted loops in conventional interlock knit textiles. It has been found that interlock knit textiles including a plurality of knitted loops having the unique knitted loop shape exhibit improved stretch properties as compared to conventional interlock knit textiles. One way of quantifying knitted loop shape is to determine the loop distance ratio for a knitted loop using the method disclosed herein. The knitted loops in conventional interlock knit textiles have been found to exhibit an average loop distance of 0.85 or greater. The disclosed interlock knit textiles can have an average loop distance of less than 0.85. In one aspect, the interlock knitted textile disclosed herein is an interlock knitted textile in which a plurality of knitted loops have an average loop distance ratio of less than 0.85, or of less than 0.83, or of less than 0.80. This unique knitted loop shape can result from altering one or more knitting machine settings, such as by altering the machine knitting settings to favor the formation of shorter, wider knitted loops. The method of manufacturing the disclosed interlock knit textiles can include altering settings such as tension and/or a cam setting before or during a machine knitting process. Other variables such as the types of first and second yarns used can also contribute to formation and retention of the unique knitted loop shape or can further facilitate improvement of the textile stretch properties of the interlock knit textile or can further facilitate formation and retention of the unique knitted loop shape and the improved textile stretch properties.

In another aspect, the disclosed interlock knit textiles can include the structural property of the first yarn comprising or consisting of fine filaments, such as a first yarn comprising or consisting of filaments having an average dpf of 0.8 or less. It has been found that using a first yarn comprising or consisting of fine filaments in the disclosed interlock knit textiles can result in the interlock knit textiles exhibiting improved stretch properties as compared to conventional interlock knit textiles. Without being bound by theory, it is believed that the use of fine filaments in the first yarn can reduce the degree to which the wales of the knit structure limit stretch in the length direction. The use of fine filaments in the first yarn can also contribute to formation and retention of the unique knitted loop shape. The fine filaments of the first yarn can have an average dpf of 0.8 or less, such as an average dpf of 0.7 or less, or an average dpf of 0.6 or less, or an average dpf of 0.5 or less, or can have an average dpf of about 0.5. The first yarn can have a linear mass density of from about 20 denier (D) to about 80 D, or of from about 30 D to about 70 D, or of from about 40 D to about 60 D. The fine filaments of the first yarn can comprise or consist of nylon filaments, regenerated cellulosic filaments, polyester filaments, or any combination thereof. In one aspect, the first yarn is a non-elasticated yarn consisting of a plurality of filaments chosen from polyester filaments, nylon filaments, regenerated cellulosic filaments, and any combination thereof, and the plurality of filaments have an average dpf of 0.6 or less. Combining a first yarn comprising the fine filaments with a second bare elasticated yarn can further facilitate the formation and retention of the unique knitted loop shape or can further facilitate improvement of the textile stretch properties of the interlock knit textile or can further facilitate formation and retention of the unique knitted loop shape and the improved textile stretch properties. In one aspect, the first yarn consists of fine filaments having a dpf of 0.6 or less, and the second yarn consists of a 60 D to 80 D bare single filament elasticated yarn.

In yet another aspect, the disclosed interlock knit textiles can have the structural property of including a second yarn comprising or consisting of an elastomeric material having a lower hysteresis than conventional elastane. It has been found that using a second yarn comprising or consisting of an elastomeric material having a lower hysteresis than conventional elastane (e.g., having improved stretchability and/or recovery as compared to conventional elastane) can result in the disclosed interlock knit textiles exhibiting improved stretch properties as compared to conventional interlock knit textiles. Without being bound by theory, it is believed that the use of the lower hysteresis elastomeric material in the second yarn can reduce the degree to which the wales of the knit structure limit stretch in the length direction. The use of the lower hysteresis elastomeric material in the second yarn can also contribute to formation and retention of the unique knitted loop shape. In one aspect, the second yarn is an elasticated yarn comprising or consisting of an elastomeric material having a hysteresis than is at least 5% lower than the hysteresis of conventional elastane, such as at least 10% lower or at least 15% lower or at least 20% lower or at least 25% lower. The second yarn can be an elasticated yarn having a lower hysteresis (e.g., at least 5% lower hysteresis, or at least 10% lower hysteresis, or at least 15% lower hysteresis, or at least 20% lower hysteresis or at least 25% lower hysteresis) as compared to a conventional elastane yarn of the same denier and structure (e.g., size of filaments, number of filaments, wrapped or unwrapped, etc.) as the second elasticated yarn. Combining a first yarn comprising or consisting of the fine filaments with a second elasticated yarn consisting of the elastomeric material having the lower hysteresis can further facilitate the formation and retention of the unique knitted loop shape or can further facilitate improvement of the textile stretch properties of the interlock knit textile or can further facilitate formation and retention of the unique knitted loop shape and the improved textile stretch properties. In one aspect, the first yarn consists of fine filaments having a dpf of 0.6 or less, and the second yarn consists of the elastomeric yarn having a hysteresis at least 10% lower than an equivalent conventional elastane yarn having the same structure.

In one aspect, the disclosed interlock knit textiles exhibit improved textile stretch properties (including percent elongation and modulus) as compared to the stretch properties of conventional interlock knit textiles. The disclosed interlock knit textiles can exhibit improved directional stretch properties in the length direction. The disclosed interlock knit textiles can exhibit improved textile stretch properties based on comparing the directional stretch properties in the length and width directions, such as determining the difference between the directional stretch properties in the length direction and the directional stretch properties in the width direction. In an aspect, as compared with a conventional interlock knit textile, the average percent elongation in the length direction (i.e., a length direction average percent elongation) is increased while an average elastic modulus in the length direction (i.e., a length direction average modulus) is decreased (as these properties are inversely proportional). In another aspect, the average percent elongation in the length direction is increased while the average percent elongation in the width direction stays the same or decreases as compared to a conventional interlock knit textile made using similar yarns and similar knitting parameters. In another aspect, as compared with a conventional interlock knit textile, the difference between the values for average percent elongation and average modulus in the length direction and in the width direction are lower than for an equivalent conventional interlock knit textile, meaning that the textile stretch properties are more balanced between the length and width directions in the disclosed interlock knit textile. In one aspect, the interlock knit textiles disclosed herein exhibit at least one textile stretch property chosen from d) the interlock knit textile has a length direction average percent elongation, a width direction average percent elongation, and an absolute value of a difference between the length direction average percent elongation and the width direction average percent elongation is less than 70 percentage points; e) the interlock knit textile has a length direction average modulus at 50% strain, a width direction average modulus at 50% strain, and an absolute value of a difference between the length direction average modulus at 50% strain and the width direction average modulus at 50% strain is less than 70 grams force (gf); and f) the interlock textile has a length direction average modulus at 80% strain, a width direction average modulus at 80% strain, and an absolute value of a difference between the length direction average modulus at 80% strain and the width direction average modulus at 80% strain is less than 70 gf.

The present disclosure is also directed to methods of manufacturing interlock knit textiles. The disclosed methods include knitting at least two courses having an interlock knit structure with a first yarn and a second yarn to form the disclosed interlock knit textile. In one aspect, the knitting includes using a circular knitting machine and includes a first knit cam mechanism associated with a dial of the circular knitting machine that is configured to actuate a plurality of needles of a first needle bed and a second knit cam mechanism associated with a cylinder of the circular knitting machine that is configured to actuate a plurality of needles of a second needle bed. A top portion of the second knit cam mechanism associated with the cylinder is located beneath a distal end of the second needle bed. In another aspect, the knitting machine is a circular knitting machine having a first knit cam mechanism associated with a dial of the circular knitting machine that is configured to actuate a plurality of needles of a first needle bed and a second knit cam mechanism associated with a cylinder of the circular knitting machine that is configured to actuate a plurality of needles of a second needle bed. The method also includes offsetting a position of the first knit cam mechanism associated with the dial of the circular knitting machine relative to a position of the second knit cam mechanism associated with the cylinder of the circular knitting machine by a separation distance that is greater than 3.5 needles. The method further includes knitting, using the circular knitting machine, at least two courses with a first yarn plated with a second yarn with the first knit cam mechanism and the second knit cam mechanism in their relative offset positions to form the interlock knit textile.

The present disclosure is also directed to the interlock knit textile manufactured using these methods, including interlock circular weft knit textiles, i.e., interlock knit textiles which are circular weft knit textiles. The disclosure also provides articles comprising the disclosed interlock knit textiles, such as articles of apparel. The disclosure also provides for methods of making articles comprising affixing the interlock knit textile to a second component to make the article. The methods include methods of manufacturing articles of apparel.

Other systems, methods, features and advantages of the disclosure will be, or will become, apparent to one of ordinary skill in the art upon examination of the following figures and detailed description. It is intended that all such additional interlock knit textiles, articles, systems, methods, features and advantages be included within this description and this summary, be within the scope of the disclosure, and be protected by the following claims.

BRIEF DESCRIPTION OF THE DRAWINGS

The disclosure can be better understood with reference to the following drawings and description. Throughout the drawings, reference numbers may be re-used to indicate correspondence between referenced elements. The drawings are provided to illustrate examples described herein and are not intended to limit the scope of the disclosure. Sizes and relative positions of elements in the drawings are not necessarily drawn to scale. For example, the shapes and sizes of various elements and angles are not drawn to scale, and some of these elements are arbitrarily enlarged and positioned to improve drawing legibility.

DETAILED DESCRIPTION

Figure 1:
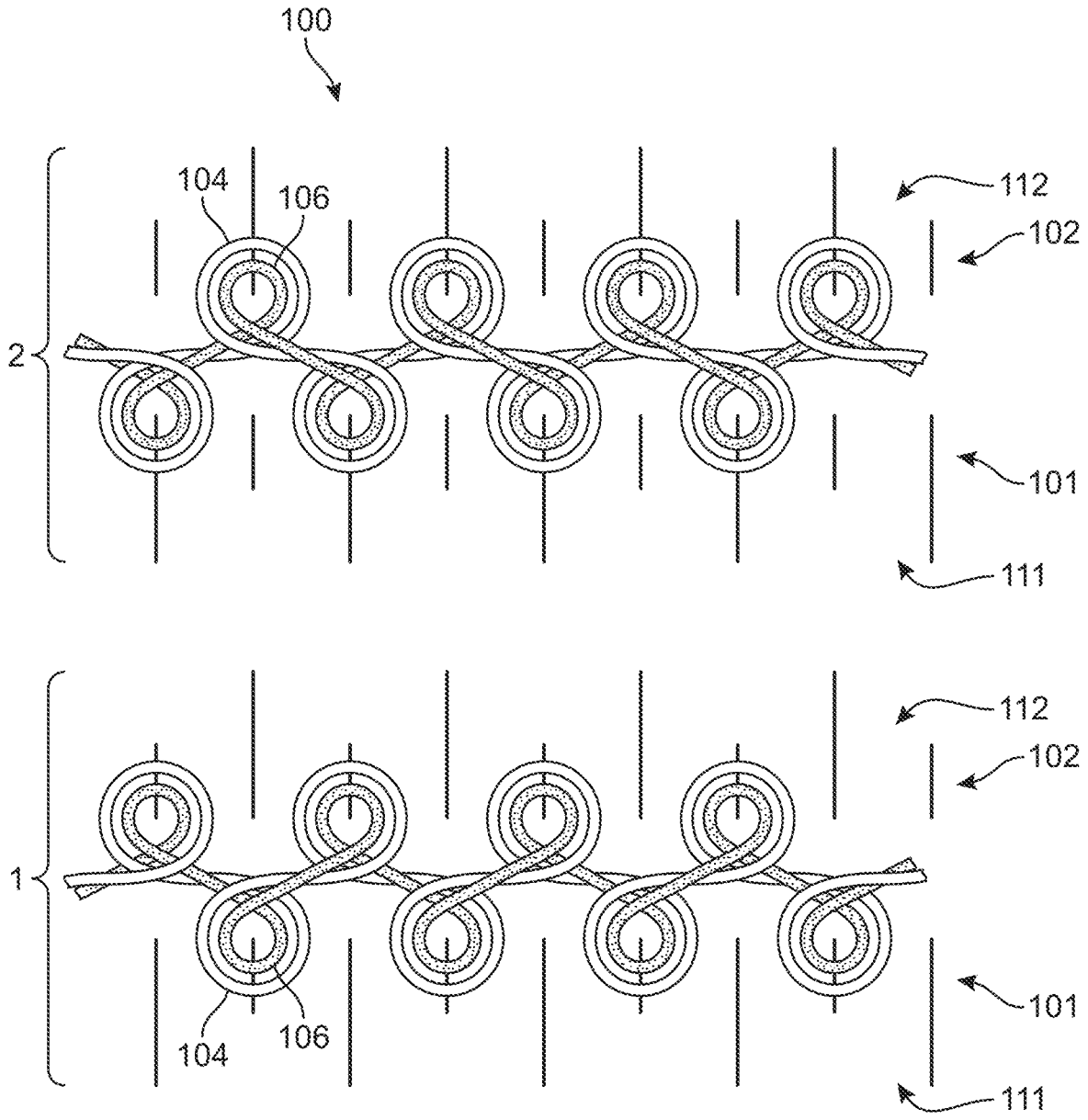
FIG. 1 is a schematic view of an example of a knitting diagram for an interlock knit textile.

In the following description, details are set forth to provide an understanding of the application. In some instances, certain structures, techniques, and methods have not been described or shown in detail in order not to obscure the application. In the context of the present disclosure, various terms are used in accordance with what is understood to be the ordinary meaning of those terms.

For consistency and convenience, directional adjectives are employed throughout this detailed description corresponding to the illustrated examples. It will be understood that each of these directional adjectives may be applied to garments or articles of clothing, as well as individual components of the article of clothing or garment. Directional terms such as "top", "bottom", "front", "back", "upper", "lower", "outer" and "inner" are used in the following description for the purpose of providing relative reference only and are not intended to suggest any limitations on how any article or garment is to be positioned during use, or to be mounted in an assembly or relative to an environment. The use of the word "a" or "an" when used herein in conjunction with the term "comprising" may mean "one", but it is also consistent with the meaning of "one or more", "at least one" and "one or more than one". Any element expressed in the singular form also encompasses its plural form. Any element expressed in the plural form also encompasses its singular form. The term "plurality" as used herein means more than one, for example, two or more, three or more, four or more, and the like.

New interlock knit textiles have been developed and are disclosed herein, along with methods of making and using the disclosed interlock knit textiles, articles comprising or consisting of the disclosed interlock textiles, and methods of making the articles. Examples of the disclosed interlock knit textiles can include unique knitted loop shapes in their knit structures, or can include fine filament yarns, or can include elasticated yarns having lower hysteresis than conventional elastane and can have improved stretch properties as compared to conventional interlock knit textiles. The interlock textiles disclosed herein can be used in a variety of articles, including apparel, footwear, sporting equipment, and accessories. It has been found that the disclosed interlock knit textiles provide advantages, including advantages in articles including articles of apparel, such as articles configured to cover a lower torso of a wearer (e.g., shorts, pants and tights), and articles configured to cover an upper torso of a wearer (e.g., tank tops, shirts and jackets).

As used herein, an interlock knit textile is understood to be a textile which comprises a portion including two or more knit courses both having an interlock knit structure. The length direction of an interlock knit structure or interlock knit textile is understood to refer to the direction or axis parallel with the knit courses in the interlock knit structure of the interlock knit textile, and a length direction stretch property (such as a length direction average modulus or length direction average percent elongation) is understood to refer to the directional stretch property when the interlock knit textile is stretched in the length direction (i.e., stretched in the direction parallel with the courses in the interlock knit structure of the interlock knit textile). The width direction is understood to be the direction or axis parallel with the wales and perpendicular to the courses in the interlock knit structure of interlock knit textile, and a width direction stretch property is understood to refer to the directional stretch property when the interlock knit textile is stretched in the width direction (i.e., stretched in the direction parallel with the wales in the interlock knit structure of the interlock knit textile). When the disclosed interlock knit textiles are knit on a knitting machine, the width of the textile is determined by the width of the needle beds in the knitting machine and with the number of needles used in the needle beds used in the knitting process. Typically the width of the interlock knit textile is less than the length of the interlock knit textile. For most knitting machines, the width direction is the width direction of the interlock knit textile as it comes off the knitting machine, and the length direction is the length direction of the interlock knit textile as it comes off the knitting machine. When the interlock knit textile is knit using a circular knitting machine, the interlock knit textile comes off the knitting machine having a long tubular shape which is later cut along its length to produce a rolled good.

In conventional interlock knit textiles, there are significant differences between the directional stretch properties exhibited when the textile is stretched in the length direction as compared to the directional stretch properties exhibited when the textile is stretched in the width direction. This difference in directional stretch properties in conventional interlock knit textiles can be quantified as a textile stretch property by determining the absolute value of the difference between the values of percent elongation or modulus in the length and width directions. Textiles such as conventional interlock knit textiles having a large absolute value of the difference between the directional stretch properties are considered to be unbalanced textiles. It is not uncommon for conventional interlock textiles to have an absolute difference between the percent elongation values of 80 percentage points or more, or to have an absolute difference between the modulus values at any one of 30, 50 and 80 percent strain of 80 grams force (gf) or more. In contrast, it has been found that the amount of directional stretch in the length direction of the disclosed interlock textiles can be increased (e.g., as compared to a conventional interlock knit textile made using similar yarns, interlock knit structures and knitting parameters, etc.) so that the amount of directional stretch in the length and width directions are closer together. Additionally or alternatively, the amount of directional stretch in the width direction of the disclosed interlock textiles can be decreased (e.g., as compared to a conventional interlock knit textile made using similar yarns, interlock knit structures and knitting parameters, etc.) so that the values in the length and width directions are closer together. These changes to the directional stretch properties in the length direction or in the width direction or to the textile stretch properties in both the length and width directions result in the disclosed interlock textiles having textile stretch properties which are more balanced, resulting in the disclosed interlock knit textiles being closer to having or having square stretch. Textiles which have the same or nearly the same levels of stretch in their width and length directions can be described as having square stretch. Square stretch is a desirable property in a textile for many reasons, including that it allows the textiles to be used in a wider variety of applications, and maximizes pattern placement during apparel construction as pieces cut from the textile can have similar directional and textile stretch properties regardless of whether they are aligned in the width or length directions.

Referring now to FIG. 1, a schematic view of an example of a knitting diagram 100 for an interlock knit textile of the present disclosure is shown. As described above, interlock knit textiles are a type of double jersey knit that have a very similar or the same appearance on the face and back sides of the textile.

In an aspect, the disclosed interlock knit textiles can be weft knit using a knitting machine that has two needle beds, including a first needle bed 101 and a second needle bed 102. The knitting machine can be a circular knitting machine. In the aspect illustrated in FIG. 1, first needle bed 101 is associated with a dial of the circular knitting machine and second needle bed 102 is associated with a cylinder of the circular knitting machine. Each of the needle beds (101, 102) include a plurality of needles, including a first plurality of needles 111 associated with first needle bed 101 and a second plurality of needles 112 associated with second needle bed 102.

In this aspect, a first plurality of needles 111 associated with first needle bed 101 are placed opposite a second plurality of needles 112 associated with second needle bed 102 in an arrangement known as interlock gaiting. Typically, the needles used for interlock gaiting have butts in short and long configurations. Needles with long and short butts are alternatively arranged in the dial (e.g., first needle bed 101) and cylinder (e.g., second needle bed 102). For example, as shown in FIG. 1, the alternating short and long butt needle configurations are represented by respective alternating short and long lines illustrated in interlock knitting diagram 100.

In some aspects, an interlock knit textile according to the present disclosure can include at least two courses of first and second yarns with intermeshed loops produced by the knitting process. As shown in FIG. 1, the interlock knit textile in accordance with the present disclosure includes at least two yarns, a first yarn 104 and a second yarn 106. In this aspect, first yarn 104 and second yarn 106 are plated together to cooperatively form a plurality of intermeshed loops defining multiple horizontal courses and vertical wales of the interlock knit textile. In an aspect, first yarn 104 comprises or consists of fine nylon filaments and second yarn 106 comprises or consists of an elastane filament.

As part of the manufacturing method, the first yarn 104 and the second yarn 106 can be plated together, meaning that the first and second yarn are combined before being knit together on the same needles at the same time. The disclosed interlock knit textiles can have a plated knit structure with the first yarn 104 defining the outermost portion of knitted loops on a face surface of the interlock knit textile or with the first yarn predominately defining the face surface of the interlock knit textile. The disclosed interlock knit textiles can have a plated knit structure with the first yarn 104 defining the outermost portion of knitted loops on a back surface of the interlock knit textile which opposes the face surface of the interlock textile, or with the first yarn predominately defining the back surface of the interlock knit textile. The disclosed interlock knit textiles can have a plated knit structure with the first yarn 104 defining the outermost portion of knitted loops on both the face and back surfaces of the interlock knit textile, or with the first yarn predominately defining the front surface and the back surface of the interlock knit textile. FIG. 1 illustrates two courses having plated knit structures with the first yarn 104 defining the outermost portion of the knitted loops. Alternatively, the disclosed interlock knit textiles can have plated knit structures with the second yarn 106 defining the outermost portion of knitted loops on a face surface of the interlock knit textile, or with the second yarn 106 defining the outermost portion of knitted loops on a back surface of the interlock knit textile, or with the second yarn 106 defining the outermost portion of knitted loops on both the face and back surfaces of the interlock knit textile.

Once the disclosed interlock knit textiles have been knitted, a sanding process can be applied to the face surface or the back surface or both the front surface and the back surface. When used on a textile, a sanding process is a mechanical finishing process that abrades the front or back surfaces of the textile to create a raised, fibrous surface. A sanding roller or belt is typically used. The sanding process can also be referred to as a seeding or peaching or grinding process. In one aspect, the manufacturing process can further comprise applying a sanding process to a face surface or a back surface of a disclosed interlock knit textile, and the disclosed interlock knit textile can have a sanded face surface or a sanded back surface. In another aspect, the manufacturing process can further comprise applying a sanding process to a surface of the disclosed interlock knit textile having a plated interlock knit structure, and the disclosed interlock knit textile can have a sanded plated surface. In one aspect, the disclosed interlock knit textile has a plated interlock knit structure with the first yarn predominately defining a surface of the textile, and the sanded surface can be the surface of the textile predominately defined by the first yarn 104. During the sanding process, the fine filaments of the first yarn 104 are raised, stretched and abraded (preferably without breaking the fine filaments), and the interlock knit structure is disrupted to some degree, making the appearance of the wales less prominent. Sanding a surface of the disclosed interlock knit textile which is a plated knit structure with the first yarn 104 predominately defining the sanded surface increases the effect of the sanding process has on the fine filaments of the first yarn 104 and has been found to provide benefits to the disclosed interlock knit textiles. In one aspect, when the disclosed interlock knit textiles include at least one sanded surface, such as when the at least one sanded surface is a plated surface with the first yarn 104 predominately defining the sanded surface, the disclosed interlock knit textile has been found to further improve the stretch properties of the textile, particularly the directional stretch in the length direction. Without being bound by theory, it is believed that the sanding process can disrupt the interlock knit structure sufficiently to allow greater stretch in the length direction, such as by stretching, raising or partially abrading the fine filaments of the first yarn 104 particularly in the knit wales.

As shown in FIG. 1, interlock knitting diagram 100 includes at least two courses that repeat to form the interlock knit textile, including a first course 1 and a second course 2. During the knitting of each individual course, only half the needles are used at a time. During first course 1, only needles having short butt configurations knit at odd positions of the cylinder (e.g., second needle bed 102) and at even positions of the dial (e.g., first needle bed 101) are used to knit the first and second yarns. During second course 2, the needles having long butt configurations knit at odd positions of the dial (e.g., first needle bed 101) and at even positions of the cylinder (e.g., second needle bed 102) are used to knit the first and second yarns. At least two courses (1, 2) are required to complete a full stitch of an interlock knit textile. This sequence described for first course 1 and second course 2 can be repeated any number of times to continue knitting a disclosed interlock knit textile to a desired size.

Figure 2B:
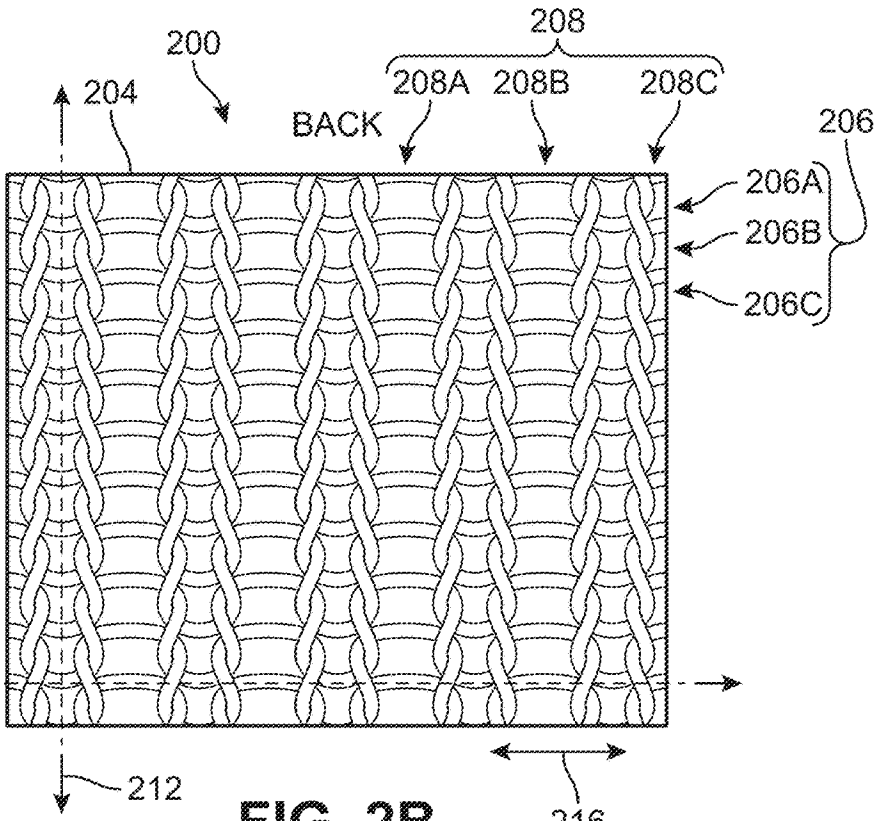
FIG. 2B is a representational view of an example of a back side of a conventional interlock knit textile.
Figure 2A:
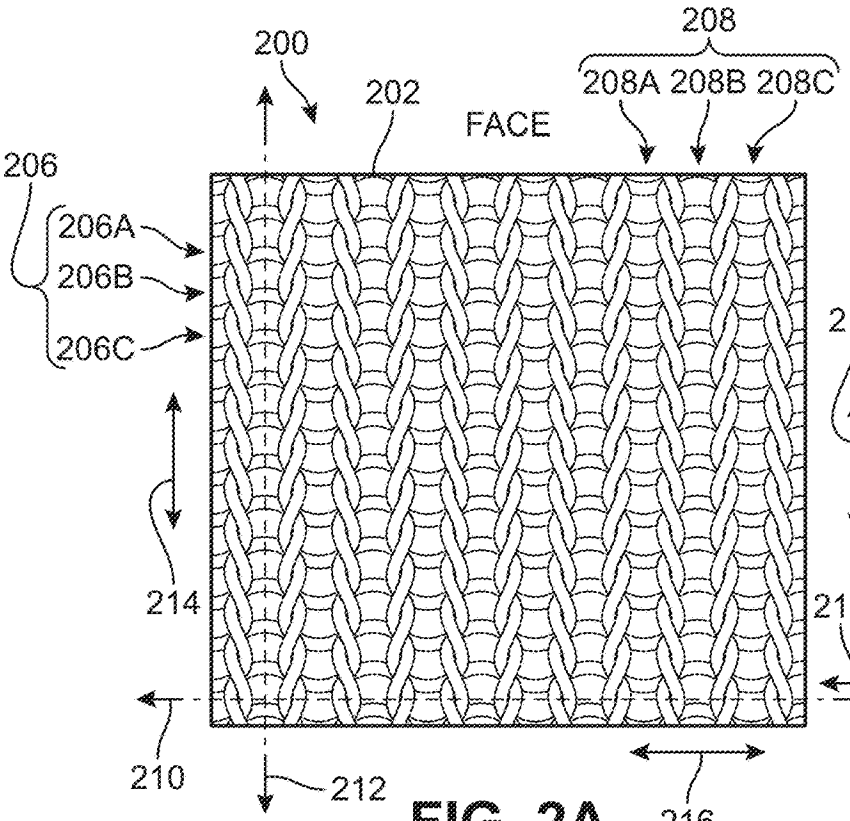
FIG. 2A is a representational view of an example of a face side of a conventional interlock knit textile.

Referring now to FIG. 2A and FIG. 2B, a representational view of an example of a conventional interlock knit textile 200 is shown. In particular, FIG. 2A illustrates a face side 202 of the conventional interlock knit textile 200 and FIG. 2B illustrates an opposite back side 204 of the conventional interlock knit textile 200. Conventional interlock knit textile 200 is formed by repeating two courses with needles in opposing positions for each of the two courses. The needle activation alternates between the cylinder and the dial to avoid the clashing of needles. In this manner, conventional interlock knit textile 200 is an "interlocking" or intermeshing of two 1×1 rib textiles together into a single textile.

As shown in FIG. 2A, face side 202 of disclosed interlock knit textile 200 includes a series of connected courses 206, including individual courses 206A, 206B, 206C. Each of individual courses 206A, 206B, 206C forms a row of interconnected loops, with an individual row extending in a course direction 210 following along the knitting direction and extending across a width direction 216 of disclosed interlock knit textile 200. The series of connected courses 206 extends down a length direction 214 of disclosed interlock knit textile 200, where length direction 214 is perpendicular to the rows of individual courses 206A, 206B, 206C. Disclosed interlock knit textile 200 also includes a series of connected wales 208, including individual wales 208A, 208B, 208C. Each of individual wales 208A, 208B, 208C forms a column of interconnected loops, with an individual column extending in a wale direction 212 parallel with length direction 214 of disclosed interlock knit textile 200. The series of connected columns of wales 208 extends across width direction 216 of disclosed interlock knit textile 200 where width direction 216 is perpendicular to columns of individual wales 208A, 208B, 208C. Similarly, FIG. 2B shows back side 204 of conventional interlock knit textile 200, including a series of interconnected courses 206 forming rows in course direction 210 and extending across parallel to width direction 216 and a series of interconnecting wales 208 forming columns in wale direction 212 extending downward parallel to length direction 214 and perpendicular to width direction 216. Because the knitted loops interlock and alternate from face side 202 to back side 204, conventional interlock knit textile 200 is more rigid and stable than that of a knit textile having a single layer rib knit structure. However, the shape of the knitted loops in the conventional interlock knit structure can limit or restrict the conventional interlock knit textile 200 from having the same directional stretch properties in length direction 214 as in width direction 216. It is believed that adjacent columns of wales (e.g., 208A, 208B, 208C) limit the mobility of the conventional knit structure to a greater degree than do the adjacent rows of courses (e.g., 206A, 206B, 206C), resulting in the stretch in length direction 214 being more limited or restricted than stretch in width direction 216.

Figure 3B:
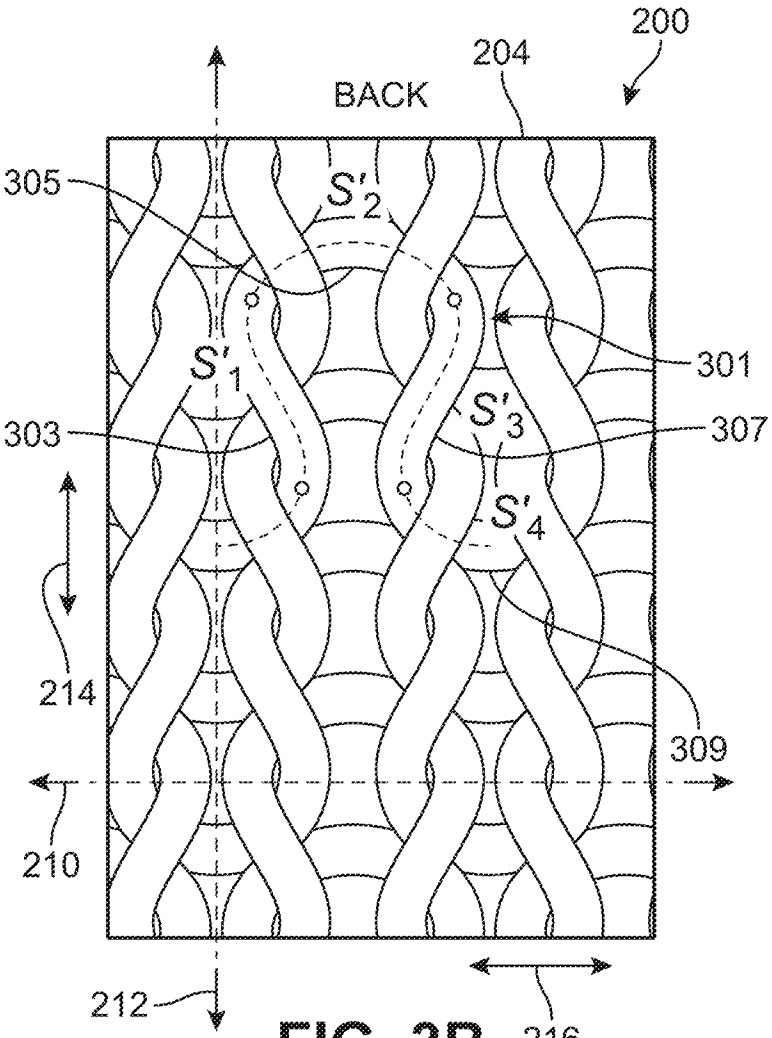
FIG. 3B is an enlarged schematic view of an example of a loop formed in a back side of a conventional interlock knit textile.
Figure 3A:
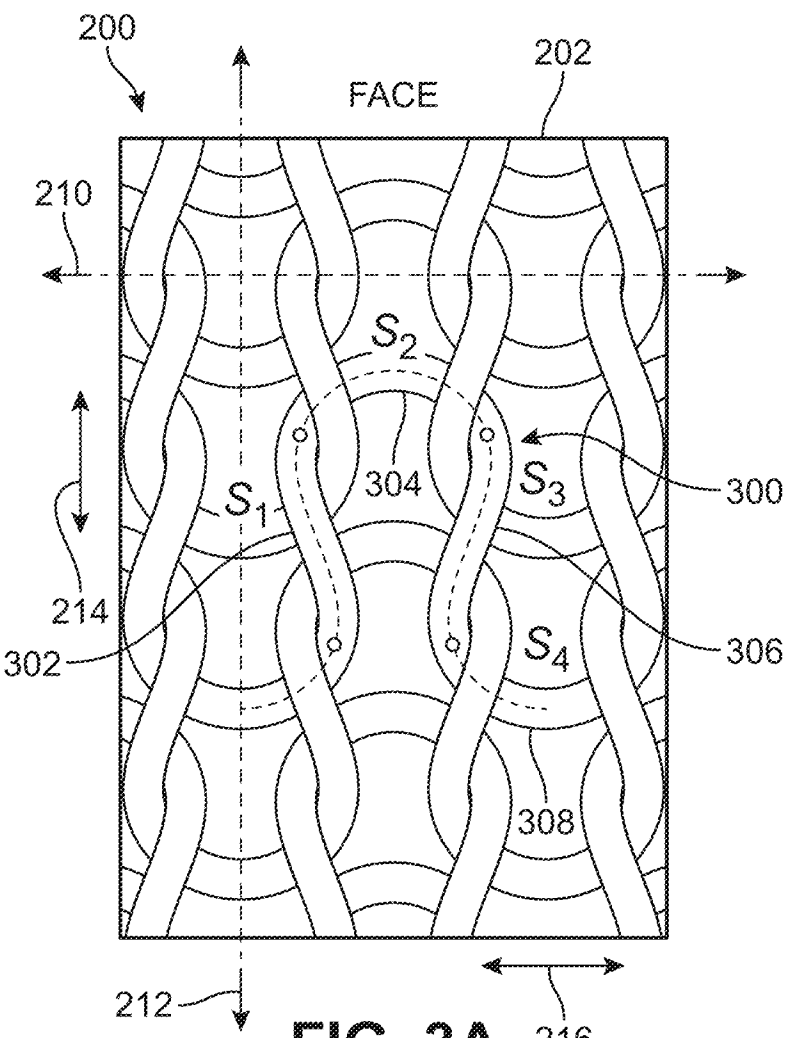
FIG. 3A is an enlarged schematic view of an example of a loop formed in a face side of a conventional interlock knit textile.

FIG. 3A and FIG. 3B show an enlarged schematic view of an example of a representative knitted loop in conventional interlock knit textile 200. Referring first to FIG. 3A, a representative conventional knitted loop 300 is shown on face side 202 of conventional interlock knit textile 200. The shape of conventional knitted loop 300 may be described with reference to multiple segments that comprise conventional knitted loop 300, including a first leg 302 ($S_1$), a top arc 304 ($S_2$), a second leg 306 ($S_3$), and a bottom arc 308 ($S_4$). First leg 302 and second leg 306 are the lateral parts of loop 300 that connect top arc 304 to the bottom half-arcs on each side, including half of bottom arc 308. Referring next to FIG. 3B, a representative conventional knitted loop 301 is shown on back side 204 of conventional interlock knit textile 200. The shape of conventional knitted loop 301 may be described with reference to multiple segments that comprise loop 301, including a first leg 303 ($S'_1$), a top arc 305 ($S'_2$), a second leg 307 ($S'_3$), and a bottom arc 309 ($S'_4$). First leg 303 and second leg 307 are the lateral parts of loop 301 that connect top arc 305 to the bottom half-arcs on each side, including half of bottom arc 309.

Figure 4B:
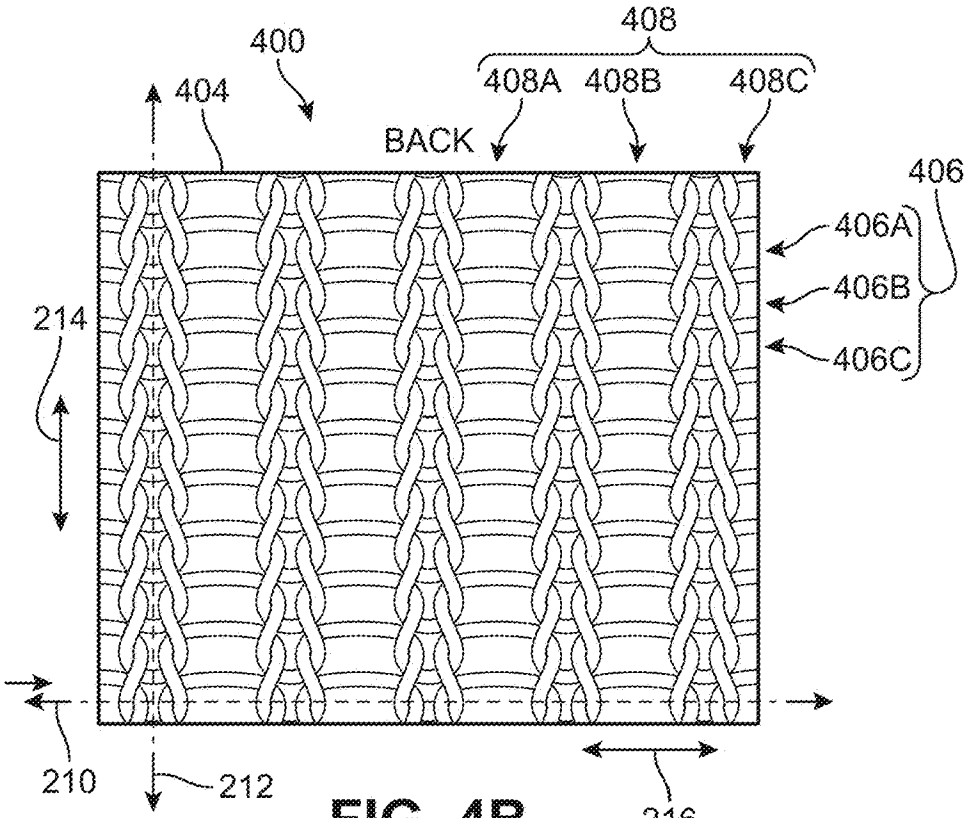
FIG. 4B is a representational view of an example of a back side of an interlock knit textile in accordance with the present disclosure.
Figure 4A:
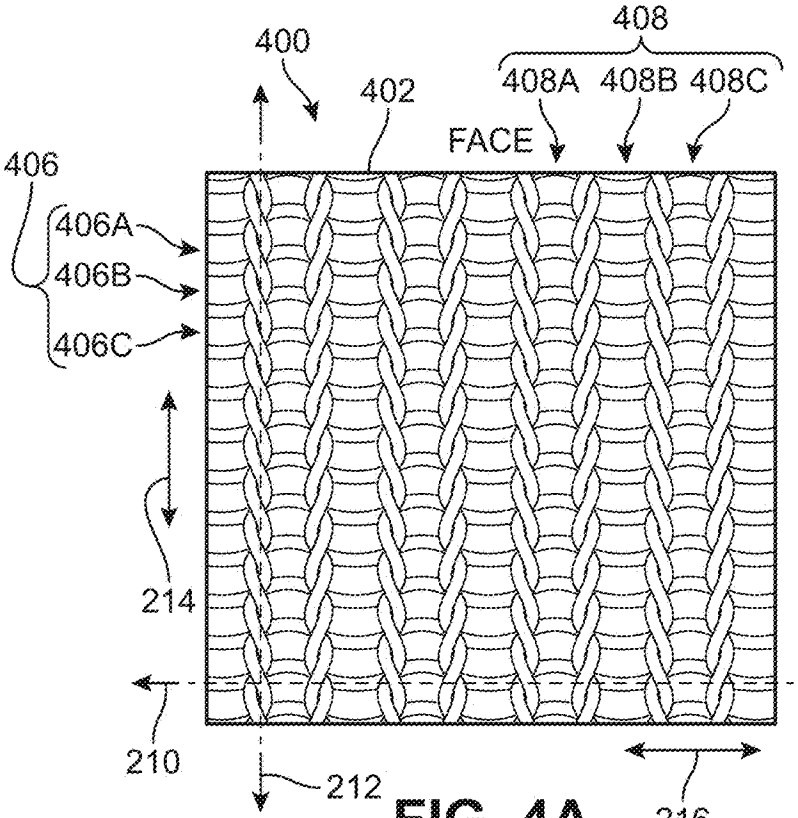
FIG. 4A is a representational view of an example of a face side of an interlock knit textile in accordance with the present disclosure.

Referring now to FIG. 4A and FIG. 4B, a representational view of an example of an interlock knit textile 400 in accordance with the present disclosure is shown. In particular, FIG. 4A illustrates a face side 402 of the disclosed interlock knit textile 400 and FIG. 4B illustrates an opposite back side 404 of the disclosed interlock knit textile 400. Disclosed interlock knit textile 400 can be knitted by repeating two courses with needles in opposing positions for each of the two courses. In one example, the needle activation can alternate between the cylinder and the dial to avoid the clashing of needles. In this manner, disclosed interlock knit textile 400 is an "interlocking" or intermeshing of two 1×1 rib textiles together into a single textile.

As shown in FIG. 4A, face side 402 of disclosed interlock knit textile 400 includes a series of connected courses 406, including individual courses 406A, 406B, 406C. Each of individual courses 406A, 406B, 406C forms a row of interconnected loops, with an individual row extending in course direction 210 following along the knitting direction and extending across width direction 216 of disclosed interlock knit textile 400. The series of connected courses 406 extends down length direction 214 of disclosed interlock knit textile 400, where length direction 214 is perpendicular to course direction 210 of the rows of individual courses 406A, 406B, 406C. Disclosed interlock knit textile 400 also includes a series of connected wales 408, including individual wales 408A, 408B, 408C. Each of individual wales 408A, 408B, 408C forms a column of interconnected loops, with an individual column extending in wale direction 212 down length direction 214 of disclosed interlock knit textile 400. The series of connected columns of wales 408 extends across width direction 216 of disclosed interlock knit textile 400 where width direction 216 is perpendicular to columns of individual wales 408A, 408B, 408C. Similarly, FIG. 4B shows back side 404 of disclosed interlock knit textile 400, including a series of interconnected rows of courses 406 forming rows in course direction 210 and extending across in a direction parallel to width direction 216 and a series of interconnected columns of wales 408 forming columns in wale direction 212 extending downward parallel to length direction 214 and perpendicular to width direction 216. In contrast with conventional interlock knit textile 200, in some aspects, the knitted loop shape of disclosed interlock knit textile 400 may allow for more stretch in length direction 214 of the disclosed interlock knit textile 400, resulting in the directional stretch properties (e.g., percent elongation, modulus) in length direction 214 being closer to or the same as the directional stretch properties in width direction 216 of the disclosed interlock knitted textile 400, resulting in the textile stretch being more balanced or square in the disclosed interlock knit textile 400.

As previously described, the disclosed interlock knitted textiles 400 can comprise one or more of three specific structural properties, a first one of which is a unique knitted loop shape. The one or more structural properties can contribute to the improved directional and textile stretch properties, including improved directional stretch in length direction 214 of the disclosed interlock knit textile 400. Other structural properties which can contribute to improved stretch are the types of first and second yarns used to knit the interlock knit textile 400. In one aspect, the unique knitted loop shape of disclosed interlock knit textile 400 allows the disclosed interlock knit textile 400 to stretch more in length direction 214 as compared to the conventional interlock knit textile 200. The interlock knit structures and knit textiles 400 can include a plurality of knitted loops having a different (i.e., unique) shape as compared to the knitted loop shape of conventional interlock knit textile 200. Various factors can contribute to the production and retention of the unique knitted loop shape in the disclosed knit textiles 400, including modifications made during the knitting process and the yarns used. The unique knitted loop shape, alone or in combination with a specific first yarn or second yarn or specific first and second yarns can result in improved textile stretch properties. The improved stretch properties can include greater percent elongation or reduced modulus in length direction 214 perpendicular to the series of connected wales 408 of the disclosed interlock knit textile 400. The improved stretch properties can include reduced percent elongation or increased modulus in the width direction perpendicular to the series of connected courses 406. The improved stretch properties can include directional or textile stretch properties which have less variability or have a smaller average absolute difference between length direction 214 and width direction 216 as compared to conventional interlock knit textiles 200.

Figure 5B:
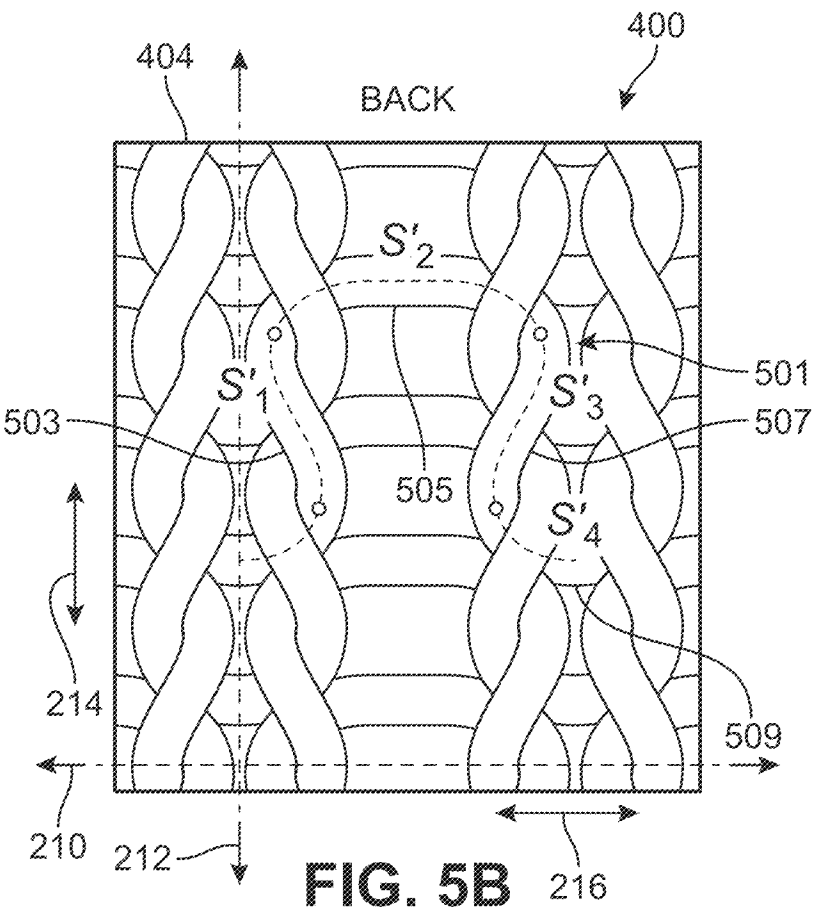
FIG. 5B is an enlarged schematic view of an example of a loop formed in a back side of an interlock knit textile in accordance with the present disclosure.
Figure 5A:
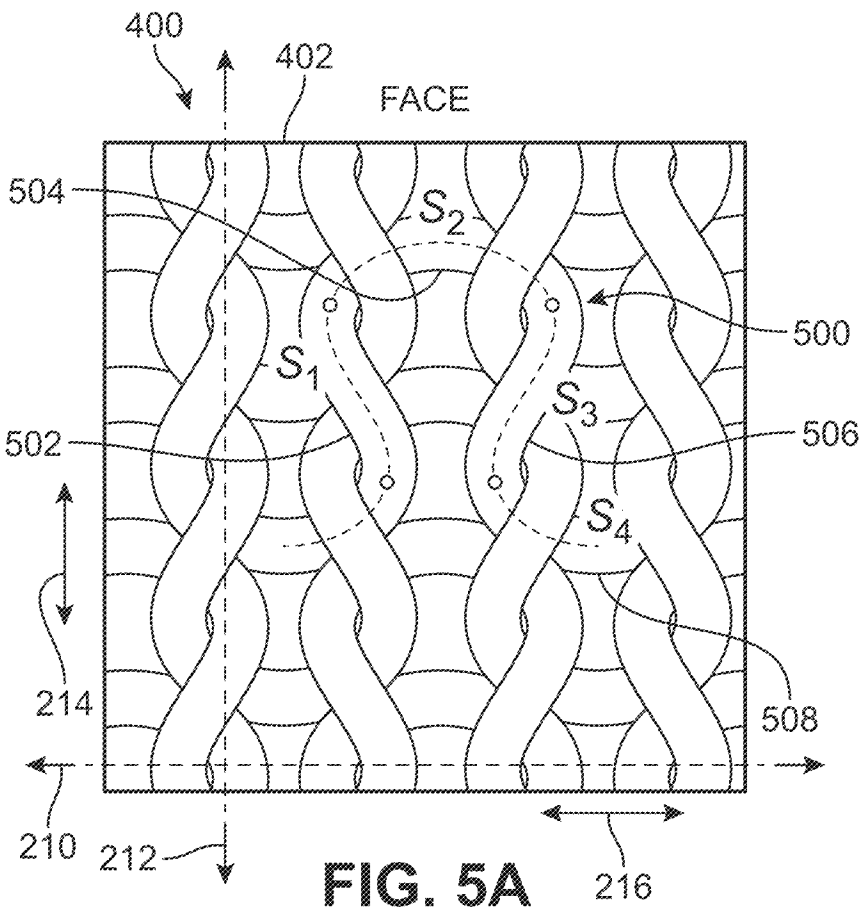
FIG. 5A is an enlarged schematic view of an example t of a loop formed in a face side of an interlock knitted in accordance with the present disclosure.

FIG. 5A and FIG. 5B show an enlarged schematic view of an example of a representative knitted loop in disclosed interlock knit textile 400. Referring first to FIG. 5A, a representative knitted loop 500 is shown on face side 402 of disclosed interlock knit textile 400. The shape of knitted loop 500 can be described with reference to multiple segments that comprise knitted loop 500, including a first leg 502 ($S_1$), a top arc 504 ($S_2$), a second leg 506 ($S_3$), and a bottom arc 508 ($S_4$). First leg 502 and second leg 506 are the lateral parts of knitted loop 500 that connect top arc 504 to the bottom half-arcs on each side, including half of bottom arc 508. Referring next to FIG. 5B, a representative knitted loop 501 is shown on back side 404 of disclosed interlock knit textile 400. The shape of knitted loop 501 can be described with reference to multiple segments that comprise knitted loop 501, including a first leg 503 ($S'_1$), a top arc 505 ($S'_2$), a second leg 507 ($S'_3$), and a bottom arc 509 ($S'_4$). First leg 503 and second leg 507 are the lateral parts of knitted loop 501 that connect top arc 505 to the bottom half-arcs on each side, including half of bottom arc 509.

In one aspect, the knitted loops of disclosed interlock knit textiles 400 have a unique knitted loop shape which is shorter and wider than the knitted loop shape in conventional interlock knitted textiles 200. Modifications made during the knitting process of disclosed interlock knit textile 400, or the yarns used, or both in combination can favor the formation and retention of the unique knitted loop shape. For example, as shown in FIGS. 5A and 5B, knitted loops 500, 501 have a squatter and more compact arrangement than knitted loops 300, 301 of conventional interlock knit textiles shown in FIGS. 3A and 3B. The unique shape of the knitted loop shape of loops 500, 501 of the disclosed interlock knit textile 400 can contribute to the improved stretch properties, such as improved directional stretch properties in the length direction compared to the knitted loop shape of knitted loops 300, 301 of conventional interlock knit textile 200.

In one aspect, the shape of the knitted loops can be described with reference to a loop distance ratio that represents the proportional relationship of the length of the knitted loop to its width. That is, the loop distance ratio is a measurement of the squatness of the shape of the knitted loop shape (i.e., a shorter length in proportion to its width as compared to a knitted loop shape in a conventional interlock knit textile). For example, a loop distance ratio of 1 represents a knitted loop shape having proportionally similar length and width. A number greater than 1 for the loop distance represents an elongated knitted loop shape with a length greater than its width, and a number less than 1 represents a shortened knitted loop shape with a width greater than its length. Accordingly, a smaller number for the loop distance ratio represents a wider and shorter (e.g., squatter) knitted loop shape as compared to a knitted loop shape having a larger number.

Figure 6:
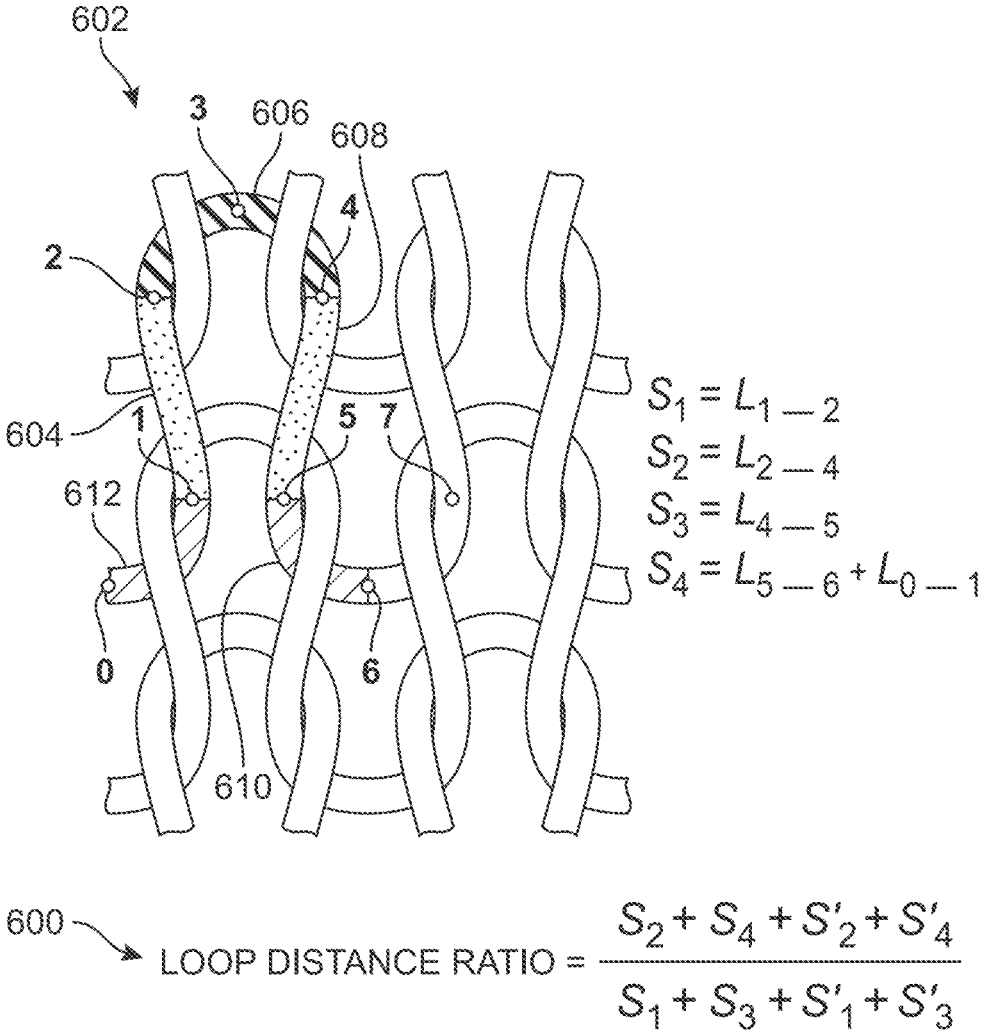
FIG. 6 is a schematic view illustrating a formula for calculating a loop distance ratio for a knitted loop of a textile.

Referring now to FIG. 6, a formula 600 for calculating a loop distance ratio for an example knitted loop 602 of a textile is shown. As shown in FIG. 6, example knitted loop 602 includes multiple segments extending between the points shown in FIG. 6. A complete loop is composed of a loop stem, which extends between points 1-2-3-4-5, and a sinker loop, which extends between points 5-6-7. The sinker loop connects two adjacent loops to each other. The segments that comprise loop 602 include a first leg 604 extending between points 1-2, a top arc 606 extending between points 2-4, a second leg 608 extending between points 4-5, and a bottom arc that extends between points 5-6-7. In the example illustrated in FIG. 6, points 1, 2, 4 and 5 indicate the points of maximum contact between the yarn of example knitted loop 602 and adjacent interconnected loops, point 3 indicates the middle of the loop stem portion of example knitted loop 602, and point 6 indicates the middle of the sinker loop portion of example knitted loop 602. For ease of illustration, the bottom arc can be represented by two half-arcs, including a first half arc 610 extending between points 5-6 and a second half arc 612 extending between points 0-1 on an opposite side of loop 602. Second half arc 612 is identical to the half arc extending between points 6-7 that connects loop 602 to the adjacent loop.

In an example, formula 600 for calculating a loop distance ratio for loop 602 can be represented as:

$$\text{Loop Distance Ratio} = \frac{(S2 + S4 + S'2 + S'4)}{(S1 + S3 + S'1 + S'3)}.$$

Where $S_1$=length between points 1-2, $S_2$=length between points 2-4, $S_3$=length between points 4-5, and $S_4$=length between points 5-7, and the values for S are measured with respect to the face side of the fabric and the values for S' are measured with respect to the back side of the fabric. In this example, $S_1$ corresponds to first leg 604, $S_2$ corresponds to top arc 606, $S_3$ corresponds to second leg 608, and $S_4$ corresponds to the sum of first half arc 610 and second half arc 612.

Formula 600 can be applied to determine the loop distance ratios associated with representative knitted loops 300, 301 of conventional interlock knit textile 200 shown in FIGS. 3A and 3B and representative knitted loops 500, 501 of the disclosed interlock knit textile 400 shown in FIGS. 5A and 5B.

As described in Table 1, samples of a conventional interlock knit textile 200 and a disclosed interlock knit textile 400 were knit on a circular knitting machine using the same first multifilament yarns and second elasticated yarns. For the conventional interlock knit textile 200, the first and second yarns were plated together and knit on a circular knitting machine using conventional knitting parameters, while the disclosed interlock knit textile 400 was knit on the same circular knitting machine except the method used the knitting machine parameters disclosed herein. Photomicrographs of the samples were taken and enlarged to determine the lengths of loop segments for knitted loops of each sample. FIGS. 5 and 6 illustrate the photomicrographs of disclosed and conventional interlock knit textile the application of Formula 600 to determine the loop shapes for the first multifilament yarn in the interlock knit textiles. Table 1 below includes the lengths for each loop segment, measured in micrometers (μm) for each segment of face side loops(S) and back side loops (S') for loops 300, 301 of interlock knit textile 200 and 500, 501 of interlock knit textile 400.

TABLE 1

| | Conventional Interlock Knit Textile 200 Loop distance ratio: ~0.85 | | Disclosed Interlock Knit Textile 400 Loop distance ratio: ~0.78 | |
|---|---|---|---|---|
| | Face side loop 300 | Back side loop 301 | Face side loop 500 | Back side loop 501 |
| $S_1$ (microns) | 571.95 | 727.97 | 772.42 | 620.42 |
| $S_2$ (microns) | 705.11 | 525.11 | 579.66 | 680.55 |
| $S_3$ (microns) | 553.98 | 632.88 | 663.67 | 555.27 |
| $S_4$ (microns) | (299.36 + 294.12) | (121.59 + 175.11) | (238.20 + 220.00) | (166.05 + 163.43) |

Calculating the loop distance ratio using formula 600 for conventional interlock knit textile 200 and disclosed interlock knit textile 400 using the values from Table 1 results in a loop distance ratio of ~0.85 for the conventional interlock knit textile 200 and a loop distance ratio of ~0.78 for disclosed interlock knit textile 400. As described above, the smaller value for the loop distance ratio of interlock knit textile 400 compared to interlock knit textile 200 represents a wider and shorter (e.g., squatter) loop shape for knitted loops 500, 501 of disclosed interlock knit textile 400 compared with knitted loops 300, 301 of conventional interlock knit textile 200. This squatter shape of the knitted loops 500, 501 of the disclosed interlock knit textile 400 may be due to modifications made during the knitting process, the types of yarns used, or a combination of both. It is believed that this unique loop shape can contribute to the improved directional and textile stretch properties observed for the disclosed interlock knit textile 400 compared to the conventional interlock knit textile 200. One way of characterizing the unique loop shape is based on the loop distance ratio as described above. The disclosed interlock knit textile 400 can have an average loop distance ratio of less than 0.85. The disclosed interlock knit textile can have an average loop distance ratio of less than 0.83. The disclosed interlock knit textile 400 has an average loop distance ratio of less than 0.80.

The smaller value for the loop distance ratio of disclosed interlock knit textile 400 compared to conventional interlock knit textile 200 represents a wider and shorter (e.g., squatter) loop shape for knitted loops 500, 501 of disclosed interlock knit textile 400 compared with knitted loops 300, 301 of conventional interlock knit textile 200. This squatter shape of the knitted loop shape of loops 500, 501 of disclosed interlock knit textile 400 may be due to modifications made during the knitting process or the yarns used or both. The improved stretch properties can include greater directional stretch properties in the length direction, or can include decreased directional stretch properties in the width direction, or changes in both the length direction and the width direction which bring the values of the directional stretch properties in the length and width directions closer together for disclosed interlock knit textiles 400 compared to conventional interlock knit textiles 200.

The average loop distance ratio can be an average of individual loop distance ratios for a plurality of loops in a disclosed interlock knit textile 400. The average loop distance can be an average for a plurality of loops across one or more courses in an interlock knit textile, or for a plurality of courses in an individual piece or portion of a disclosed interlock knit textile 400, or for a plurality of courses in a roll or bolt of a disclosed interlock knit textile 400, or for a plurality of courses in a lot of a disclosed interlock knit textile 400. At least 10% of all knitted loops in a disclosed interlock knit structure 400 or in a portion of a disclosed interlock knit structure can have an average loop distance ratio of less than 0.85. At least 25% of all knitted loops in a disclosed interlock knit structure 400 or in a portion of a disclosed interlock knit structure can have an average loop distance ratio of less than 0.85. At least 50% of all knitted loops in a disclosed interlock knit structure 400 or in a portion of a disclosed interlock knit structure can have an average loop distance ratio of less than 0.85. A majority of all knitted loops in a disclosed interlock knit structure 400 or in a portion of a disclosed interlock knit structure can have an average loop distance ratio of less than 0.85. At least 75% of all knitted loops in a disclosed interlock knit structure 400 or in a portion of a disclosed interlock knit structure can have an average loop distance ratio of less than 0.85. All knitted loops in a disclosed interlock knit structure 400 or in a portion of a disclosed interlock knit structure can have an average loop distance ratio of less than 0.85. The average loop distance ratio can be an average loop distance of less than 0.83. The average loop distance ratio can be an average loop distance of less than 0.80.

In another aspect, altering one or more knitting machine settings during the knitting process may sufficiently alter the knitted loop structure of a sufficiently high number or proportion of all knitted loops in the textile so as to improve the stretch properties of the textile without reducing an average loop distance ratio for the entire interlock textile, or without resulting in an average loop distance ratio of less than 0.85 for the entire textile.

Figure 7:
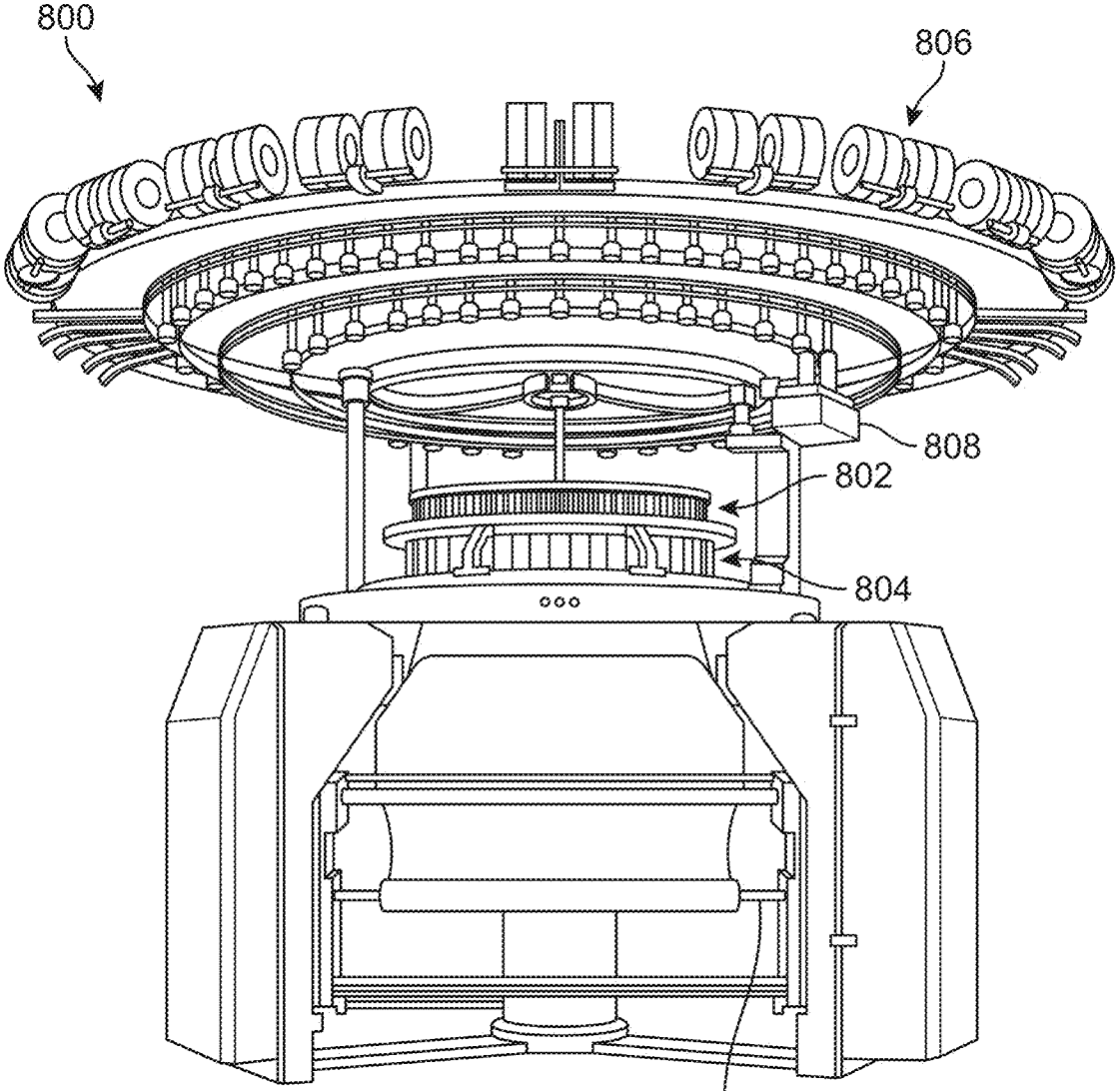
FIG. 7 is a representative view of an example of a circular knitting machine for knitting an interlock knit textile in accordance with the present disclosure.

Referring now to FIG. 7, a representative view of an example of a circular knitting machine 800 for knitting a disclosed interlock knit textile 400 is shown. In this example, circular knitting machine 800 has a dial 802 and a cylinder 804 each having a needle bed with a plurality of needles that are arranged approximately perpendicular to each other. As shown in FIG. 7, yarns 806 (including, for example, first yarn 104 and second yarn 106 shown in FIG. 1) are fed to the needles of dial 802 and cylinder 804 needle beds. Additionally, one or more yarn tensioners 808 control the tension applied to yarns 806 and can be used to control aspects of the knitting process by circular knitting machine 800. In one aspect, the interlock knit textile can be gathered or rolled up by a take-down mechanism 810 during the knitting process as the textile is being knit. It should be understood that circular knitting machine 800 is exemplary and other types of circular knitting machines can be used in accordance with the textiles and methods described herein.

Figure 8:
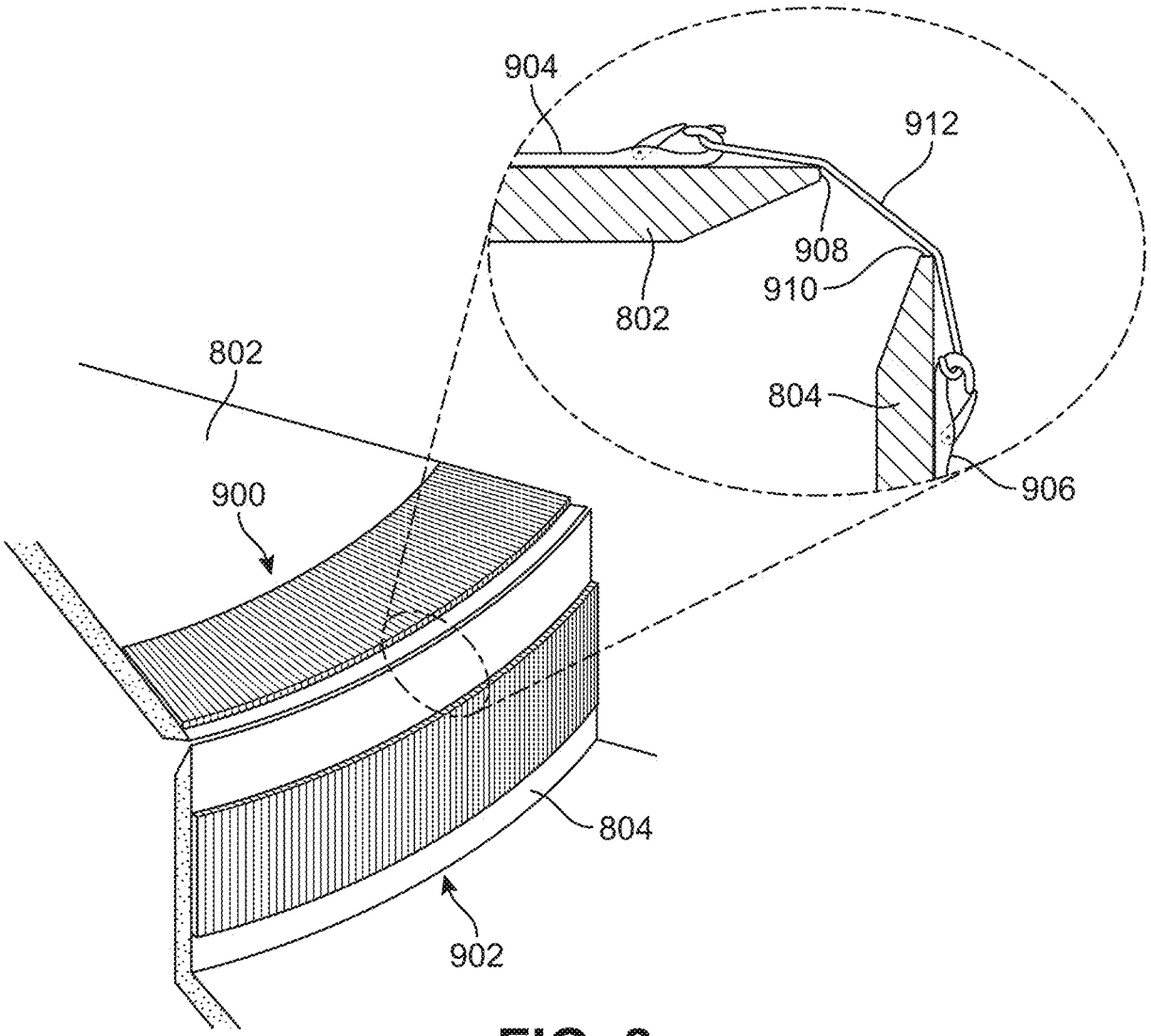
FIG. 8 is an enlarged view of an example of a pair of needle beds associated with a circular knitting machine for knitting an interlock knit textile in accordance with the present disclosure.

FIG. 8 is an enlarged view of an example of a pair of needle beds associated with circular knitting machine 800 for knitting a disclosed interlock knit textile 400. As shown in FIG. 8, a first needle bed 900 is associated with dial 802 of circular knitting machine 800 and a second needle bed 902 is associated with cylinder 804 of circular knitting machine 800. Each of first needle bed 900 and second needle bed 902 includes a plurality of needles that are used to form a knit textile. As can be seen in the close-up view in FIG. 8, a first needle 904 of the plurality of needles associated with first needle bed 900 has a generally horizontal arrangement on dial 802. A second needle 906 of the plurality of needles associated with second needle bed 902 has a generally vertical arrangement on cylinder 804 so that first needle 904 and second needle 906 move in mutually perpendicular planes when making a knitted loop.

In this aspect, an area located between a distal end 908 of the needle bed on dial 802 (e.g., first needle bed 900) and a distal end 910 of the needle bed on cylinder 804 (e.g., second needle bed 902) defines a knitting zone where yarn 912 is looped and intermeshed with other loops to form a disclosed interlock knit textile 400.

Figure 9:
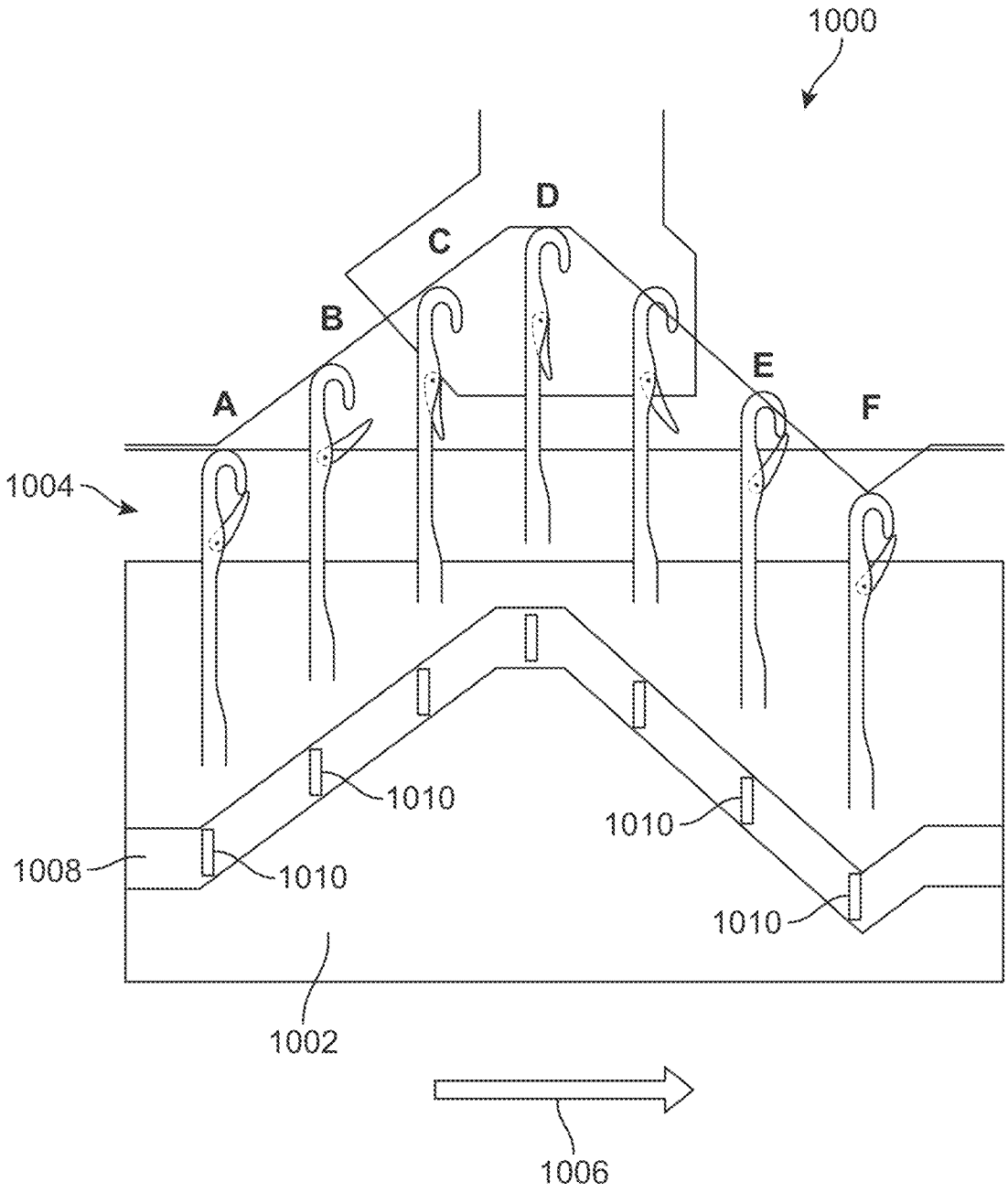
FIG. 9 is a schematic view of an example of needle actuation via a cam mechanism in a needle bed of a circular knitting machine for knitting an interlock knit textile in accordance with the present disclosure.

FIG. 9 is a schematic view of an example of needle actuation 1000 via a cam mechanism 1002 in a needle bed of a circular knitting machine for knitting a disclosed interlock knit textile.

In a circular knitting machine (e.g., circular knitting machine 800), the dial and cylinder needles are arranged in a perpendicular manner. Cylinder cams and dial cams are two different sets of cam mechanisms that control the knitting action on each needle bed (e.g., first needle bed 900 associated with dial 802 and second needle bed 902 associated with cylinder 804, shown in FIG. 8). As shown in FIG. 9, a plurality of needles 1004 associated with the cylinder are shown (e.g., cylinder 804). Cylinder cam mechanism 1002 translates the rotary movement of the circular knitting machine into a reciprocating needle actuation 1000 sequence as cam mechanism 1002 moves in a first direction 1006. Needles 1004 move up and down to form a stitch by action of cam mechanism 1002 engaging needle butts 1010 within a track 1008 as cam mechanism 1002 moves along in first direction 1006. The sloped arrangement of track 1008 of cam mechanism 1002 causes needle butts 1010 to move needles 1004 upwards and downwards in correspondence with the slope or angle of track 1008 to open and close the latches at the ends of needles 1004. For example, as shown in FIG. 9, reciprocating needle actuation 1000 sequence is shown by the arrangement of needles 1004 shown at each of A-B-C-D-E-F.

In one aspect, a cam mechanism associated with dial 802 causes a similar reciprocating needle actuation for the plurality of needles associated with dial 802. With this arrangement, a loop can be formed with yarn (e.g., first yarn 104 and second yarn 106 plated together) by needles 1004. For example, a loop can be formed within the knitting zone area disposed between the two needle beds, as shown in FIG. 8. As the circular knitting machine continues to rotate, additional loops are formed and intermeshed with each other to form the disclosed interlock knit textile 400. The disclosed interlock knit textile 400 made is then held by weight or a take-down mechanism, such as take-down mechanism 810 shown in FIG. 7.

Figure 10B:
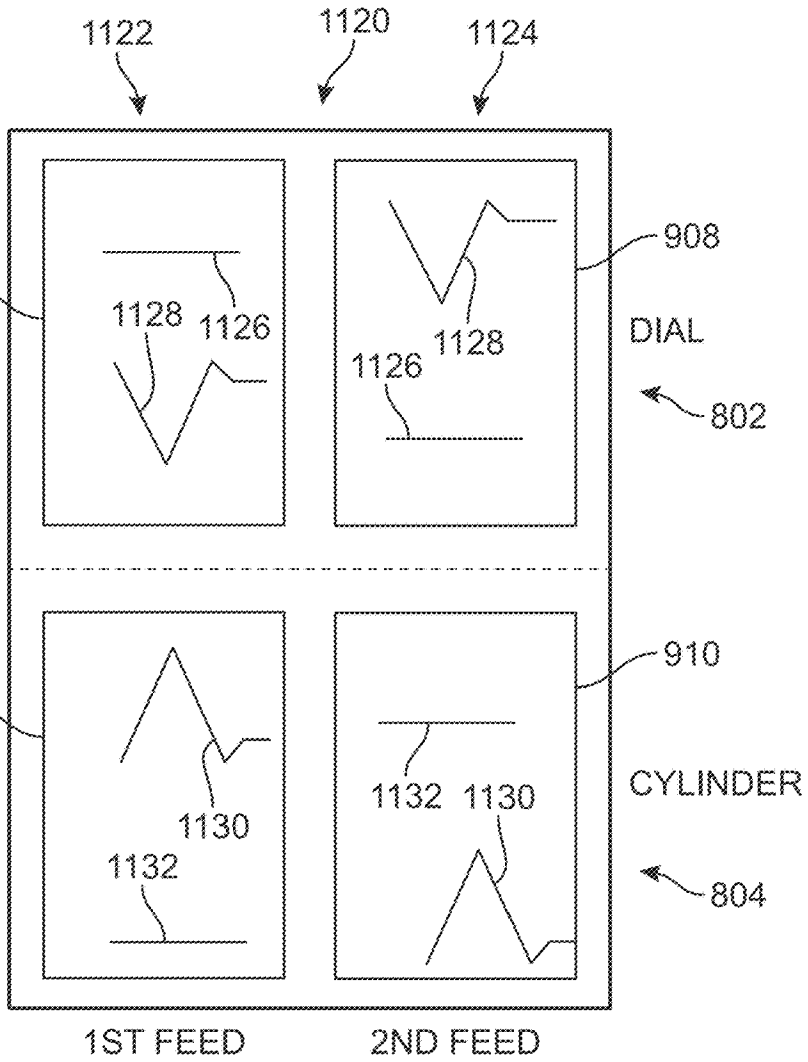
FIG. 10B is a representative view of an example of cam mechanism positions for a circular knitting machine for knitting an interlock knit textile in accordance with the present disclosure.
Figure 10A:
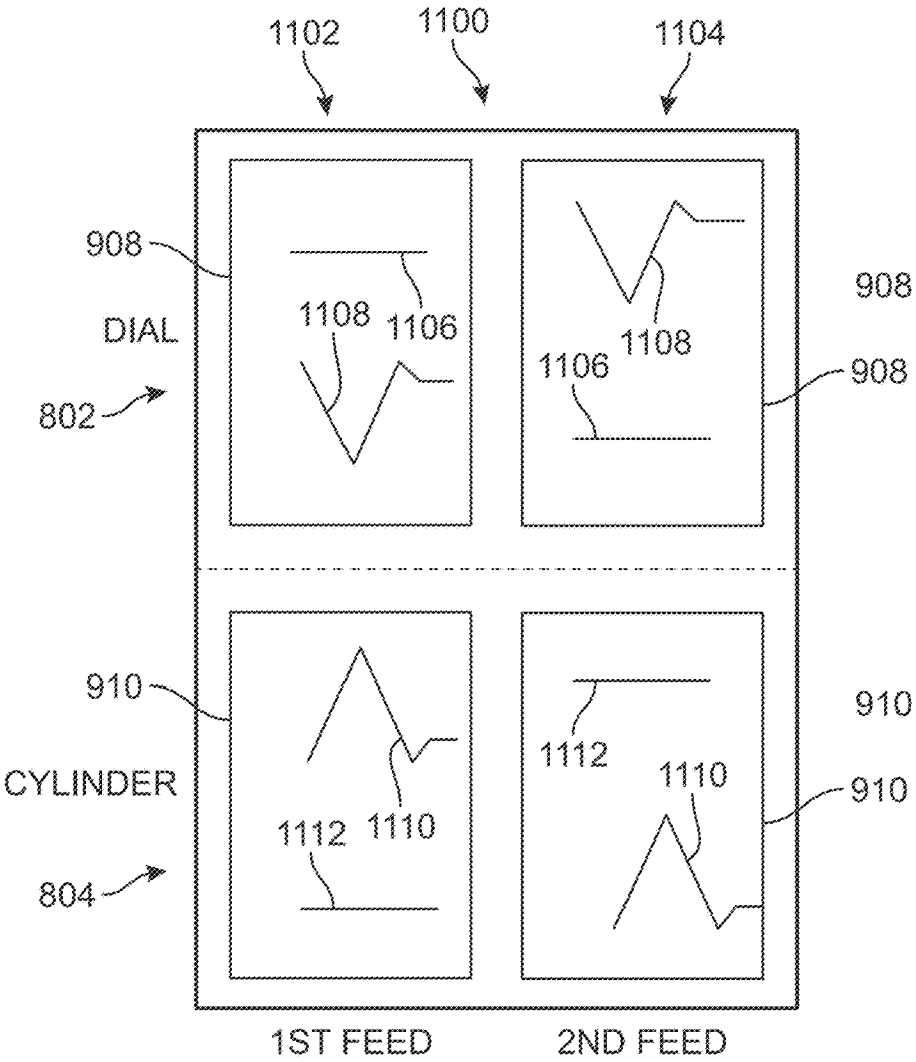
FIG. 10A is a representative view of an example of cam mechanism positions for a circular knitting machine for knitting a conventional interlock knit textile according to conventional techniques.

FIG. 10A is a representative view of an example of cam mechanism positions 1100 for a circular knitting machine for knitting a conventional interlock knit textile 200. As shown in FIG. 10A, a conventional interlock knit textile is knitted using circular knitting machine 800 with cam mechanism positions 1100 shown for a first feed 1102 forming a first course and a second feed 1104 forming a second course. Cam mechanism positions 1100 according to conventional techniques include a first float cam 1106 and a first knit cam 1108 associated with the needle bed on dial 802 of circular knitting machine 800 and a second knit cam 1110 and a second float cam 1112 associated with the needle bed on cylinder 804 of circular knitting machine 800. As shown in FIG. 10A, the positions of first float cam 1106 and first knit cam 1108 on dial 802 alternate positions between first feed 1102 and second feed 1104. Similarly, the positions of second knit cam 1110 and second float cam 1112 also alternate positions between first feed 1102 and second feed 1104. With this arrangement, the needles of dial 802 and the needles of cylinder 804 form loops in the knitting zone located between distal end 908 of the needle bed on dial 802 and distal end 910 of the needle bed on cylinder 804.

FIG. 10B is a representative view of an example of cam mechanism positions 1120 for a circular knitting machine for knitting a disclosed interlock knit textile 400. As shown in FIG. 10B, an interlock knit textile is knitted using circular knitting machine 800 with cam mechanism positions 1120 shown for a first feed 1122 forming a first course and a second feed 1124 forming a second course. Cam mechanism positions 1120 in accordance with the knitting of the present disclosure include a first float cam 1126 and a first knit cam 1128 associated with the needle bed on dial 802 of circular knitting machine 800 and a second knit cam 1130 and a second float cam 1132 associated with the needle bed on cylinder 804 of circular knitting machine 800. As shown in FIG. 10B, the positions of first float cam 1126 and first knit cam 1128 on dial 802 alternate positions between first feed 1122 and second feed 1124. Similarly, the positions of second knit cam 1130 and second float cam 1132 also alternate positions between first feed 1122 and second feed 1124. With this arrangement, the needles of dial 802 and the needles of cylinder 804 form loops in the knitting zone located between distal end 908 of the needle bed on dial 802 and distal end 910 of the needle bed on cylinder 804.

In an aspect, cam mechanism positions 1120 shown in FIG. 10B in accordance with the present disclosure for cylinder 804 are lower (i.e., beneath) cam mechanism positions 1100 shown in FIG. 10A according to conventional interlock knitting for cylinder 804. That is, second knit cam 1110 and second float cam 1112 on cylinder 804 have cam mechanism positions 1100 that are located closer to distal end 910 of cylinder 804 than cam mechanism positions 1120 of second knit cam 1130 and second float cam 1132 on cylinder 804. Cam mechanism positions 1120 of second knit cam 1130 and second float cam 1132 on cylinder 804 are located farther from distal end 910 of cylinder 804 than cam mechanism positions 1100 of second knit cam 1110 and second float cam 1112 on cylinder 804. In contrast, cam mechanism positions 1100 of first float cam 1106 and first knit cam 1108 on dial 802 according to conventional interlock knitting are the same as cam mechanism positions 1120 of first float cam 1126 and first knit cam 1128 on dial 802 in accordance with the present disclosure.

Figure 11:
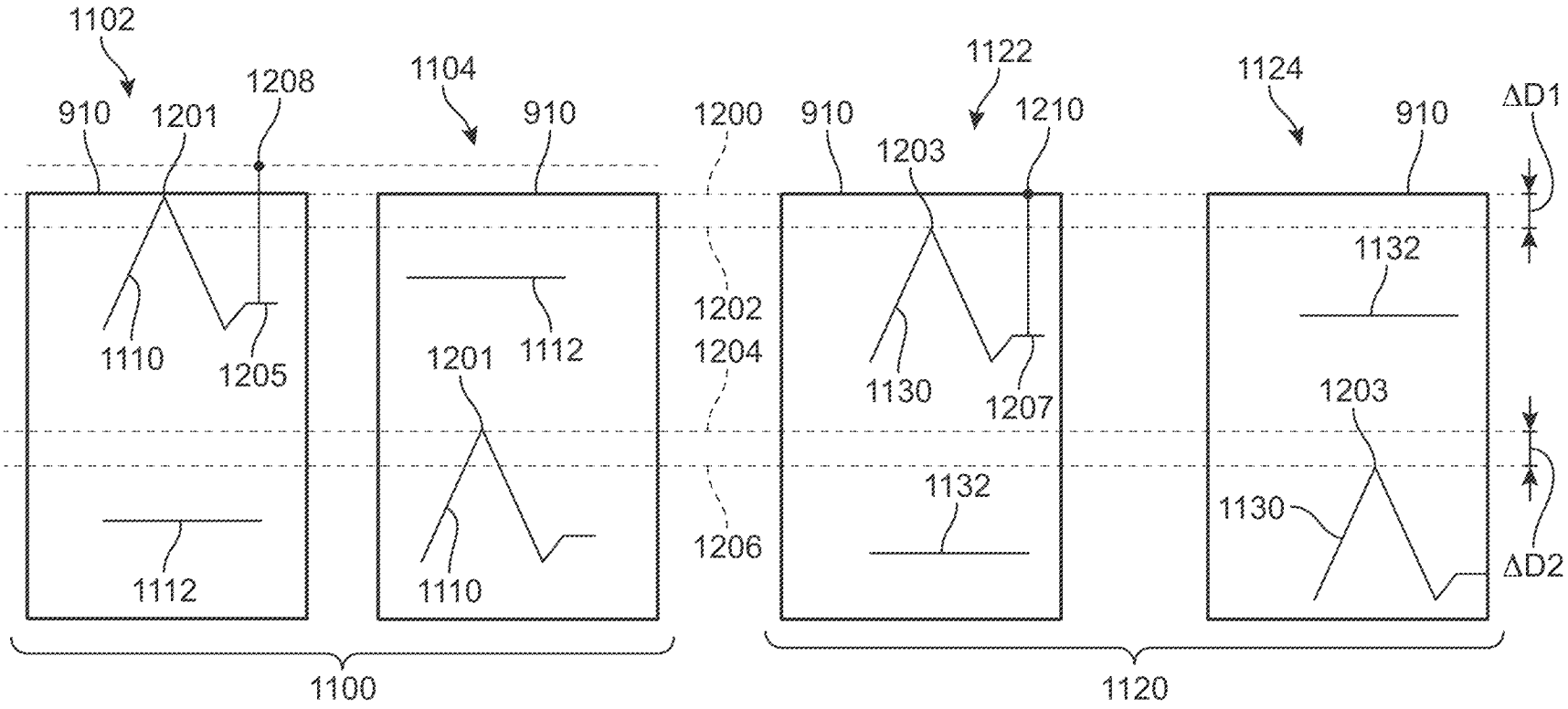
FIG. 11 is a schematic view showing the relative difference in positions of the cam mechanisms between a conventional interlock knit textile formed according to conventional techniques and an interlock knit textile formed in accordance with the methods of the present disclosure.

FIG. 11 is a schematic view showing the relative difference in positions of the cam mechanisms between a conventional interlock knit knitting process and a disclosed interlock knitting process. In accordance with the present disclosure, cam mechanism positions 1120 for cylinder 804 are lower (i.e., beneath) cam mechanism positions 1100 used according to conventional techniques for cylinder 804. For example, as shown in FIG. 11, a top portion 1201 of second knit cam 1110 on cylinder 804 has cam mechanism position 1100 extending to a first line 1200 on first feed 1102 and extending to a second line 1204 on second feed 1104. In this aspect, first line 1200 corresponds to distal end 910 of cylinder 804. With this arrangement, an initial position of a needle engaged at an end 1205 of second knit cam 1110 extends to a point 1208 that is beyond distal end 910 of cylinder 804. In one aspect, point 1208 is from 25 decimillimeters (dmm) to 75 dmm, or from 40 dmm to 60 dmm, or about 50 dmm (i.e., about 5 millimeters) beyond distal end 910 of cylinder 804.

Referring now to cam mechanism positions 1120, as shown in FIG. 11, a top portion 1203 of second knit cam 1130 on cylinder 804 has cam mechanism position 1120 extending to a third line 1202 on first feed 1122 and extending to a fourth line 1206 on second feed 1124. In this aspect, third line 1202 is beneath or below distal end 910 of cylinder 804. With this arrangement, an initial position of a needle engaged at an end 1207 of second knit cam 1130 extends to a point 1210 that is at distal end 910 of cylinder 804.

In one aspect, the difference between cam positions 1100 of second knit cam 1110 according to conventional interlock knitting techniques and cam positions 1120 of second knit cam 1130 in accordance with the present disclosure can be represented by difference D1 (ΔD1) between first line 1200 and third line 1202 for first feeds 1102, 1122 and difference D2 (ΔD2) between second line 1204 and fourth line 1206 for second feeds 1104, 1124. In an aspect, difference D1 can be from 25 decimillimeters (dmm) to 75 dmm, or can be from 40 dmm to 60 dmm, or can be about 50 dmm, and difference D2 can also be from 25 dmm to 75 dmm, or from 40 dmm to 60 dmm, or about 50 dmm. In other aspects, difference D1 and difference D2 can be larger or smaller.

As shown in FIG. 11, cam positions 1100 of second float cam 1112 on cylinder 804 for first feed 1102 and second feed 1104 can be higher or above cam positions 1120 of second float cam 1132 on cylinder 804 for first feed 1122 and second feed 1124. In one aspect, the differences between cam positions 1100 of second float cam 1112 according to conventional interlock knitting techniques and cam positions 1120 of second float cam 1132 in accordance with the present disclosure can be represented by difference D1 and difference D2 associated with second knit cam 1110 and second knit cam 1130, described above. In one aspect, with this arrangement, knitting in accordance with the present disclosure can be used to knit a disclosed interlock knit textile 400 having the unique knitted loop shape. The disclosed interlock knit textile 400 including the unique knitted loop shape may provide or contribute to a disclosed interlock knit textile 400 having improved stretch properties.

In some aspects, the relative positions of the cam mechanisms on each needle bed of a circular knitting machine can be modified as part of the formation of a disclosed interlock knit textile 400. As described above, circular knitting machine 800 includes dial 802 and cylinder 804, each having knit cams and float cams for providing needle actuation 1000 for each needle bed. In one aspect, a needle separation distance between the relative positions of the knit cams on dial 802 and cylinder 804 can be increased to assist with knitting a disclosed interlock knit textile 400, including a disclosed interlock knit textile 400 with the unique knitted loop shape, with improved stretch properties, or with both the unique knitted loop and the improved stretch properties.

Figure 12:
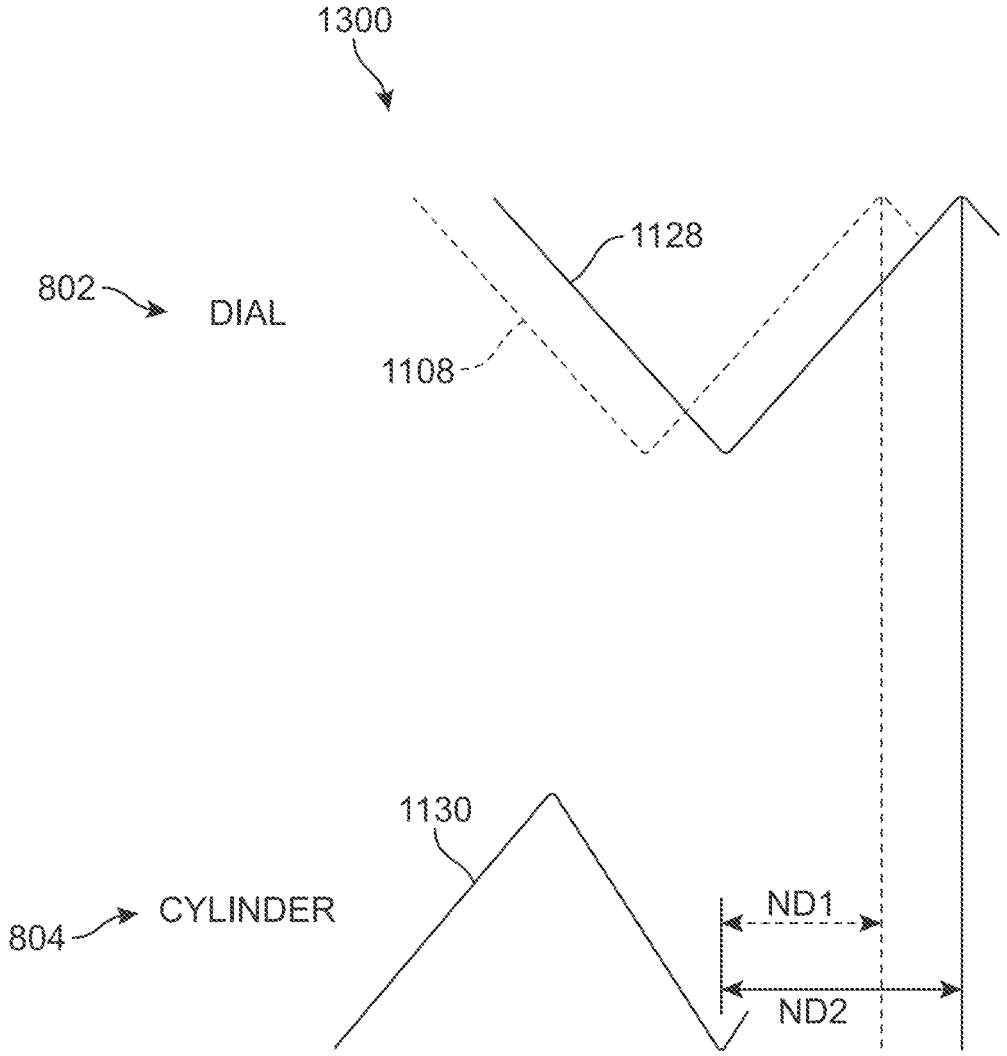
FIG. 12 is a schematic view showing the relative difference in positions between cam mechanisms in each needle bed associated with a conventional interlock knit textile formed according to conventional techniques and an interlock knit textile formed in accordance with the methods of the present disclosure.

Referring now FIG. 12, a schematic view showing a relative difference in positions or offset 1300 between cam mechanisms in each needle bed associated with a conventional interlock knit textile 200 formed according to conventional techniques and a disclosed interlock knit textile 400 knitted using a manufacturing method in accordance with the present disclosure is shown. As shown in FIG. 12, the orientation of dial 802 relative to cylinder 804 has been rotated from a perpendicular arrangement to be on the same plane for ease of illustrating relative difference in positions or offset 1300. In this aspect, relative difference in positions or offset 1300 between first knit cam 1128 on dial 802 and second knit cam 1130 on cylinder 804 of circular knitting machine 800 is increased from a first separation distance ND1 associated with a position of first knit cam 1108 on dial 802 according to conventional interlock knitting techniques to a second separation distance ND2 associated with a position of first knit cam 1128 on dial 802 in accordance with disclosed interlock knitting techniques. That is, as shown in FIG. 12, relative difference in positions or offset 1300 between the cam mechanisms on dial 802 (e.g., first knit cam 1128) and cylinder 804 (e.g., second knit cam 1130) are greater (i.e., farther apart) than the relative difference in positions between the cam mechanism on dial 802 (e.g., first knit cam 1108) and cylinder 804 (e.g., second knit cam 1110) associated with conventional interlock knitting techniques. In an example, the relative difference in positions or offset 1300 is measured in units of needle distance (ND), which may vary based on the gauge of needles used on circular knitting machine 800.

In one aspect, first separation distance ND1 associated with the offset or relative difference in positions between the cam mechanisms according to conventional interlock knitting techniques is approximately 3.5 needles. In other words, first knit cam 1108 on dial 802 and second knit cam 1110 on cylinder 804 are offset from each other by a separation distance (ND1) that is approximately 3.5 needles in width. In contrast, second separation distance ND2 associated with offset 1300 in position of first knit cam 1128 on dial 802 and second knit cam 1130 on cylinder 804 in accordance with the disclosed interlock knitting techniques is approximately 4.5 needles in width. In this aspect, ND2 is larger or increased by one needle width compared with ND1 associated with the conventional interlock knitting techniques. In other aspects, offset 1300 between the cam mechanism positions can be larger or smaller. With this arrangement, a disclosed interlock knit textile 400 can be formed in accordance with the interlock knitting techniques of the present disclosure.

In another aspect, both the cam position of the knit cam on cylinder (as described with reference to FIGS. 10A, 10B, and 11) and the relative positions of the knit cams on the dial and cylinder (as described with reference to FIG. 12) are changed on circular knitting machine 800 during the knitting process to knit a disclosed interlock knit textile 400. In other aspects, only one modification or the other (i.e., knit cam position on the cylinder or relative cam positions on dial and cylinder) can be implemented to form a disclosed interlock knit textile, such as a disclosed interlock knit textile 400 including the unique knitted loop shape, or having improved stretch properties, or both.

Additionally, in some aspects, a tension applied to one or both of the first yarn and the second yarn used during the knitting of the disclosed interlock knit textile 400 can be modified to assist with forming and retaining the unique knitted loop shape of the disclosed interlock knit textile 400. Tension can be varied the first yarn or the second yarn using tensioner 808 of circular knitting machine 800 shown in FIG. 7. Using tensioner 808, the tension applied to one or both yarns forming the disclosed interlock knit textile, for example, first yarn 104 and second yarn 106, can be varied. The tension applied to first yarn 104 may be in a range from 3 g to 5 g and the tension applied to second yarn 106 can be in a range from 4 g to 6 g. In some aspects, the amounts of tension applied to first yarn 104 and second yarn 106 during knitting of a disclosed interlock knit textile 400 can be less than the amount of tension applied to the yarns during knitting of a conventional interlock knit textile 200.

A filament is understood to be a thin, flexible threadlike object having an extremely elongated length with a very high ratio of length to cross-sectional area. Man-made filaments are typically made using processes such as extrusion that create filaments having nearly continuous uninterrupted lengths. In contrast, natural and man-made fibers have discrete lengths. Man-made fibers can be made by cutting filaments to have a discrete length. In a filament yarn, the plurality of filaments can become entangled with each during the spinning process. Optionally, the plurality of filaments can be twisted or texturized to increase the bulk of the yarn. Yarns, fibers and filaments can be quantified based on their linear mass density. Units of linear mass density include denier (D), which is the weight in grams of 9,000 meters of the yarn, filament or fiber and tex, which is the weight in grams of 1,000 meters of the yarn, filament or fiber. As many yarns include a large number of individual filaments, the average linear mass density of the individual filaments is often quantified in denier per filament (dpf) or tex per filament. Thus, a filament yarn can be quantified based on its overall linear mass density (e.g., in D) and the average linear mass density of the individual filaments (e.g., in dpf), and on the number of filaments (f) present in the yarn.

As described above, in one aspect, the disclosed interlock knitted textiles 400 can comprise one or more of three specific structural properties, a first of which is a first yarn 104 comprising a plurality of fine filaments. In another aspect, when the disclosed interlock knitted textile 400 comprises the unique knitted loop shape or second yarn 106 comprising or consisting of an elastomeric material having a lower hysteresis than conventional elastane material or comprises both the unique knitted loop shape and a second yarn 106 comprising the lower hysteresis elastomeric material, the first yarn 104 can be a first yarn 104 including a plurality of filaments having an average dpf of greater than 0.8, or greater than 0.9, or greater than 1.0. In this aspect, the first yarn 104 can have a linear mass density of from about 20 D to about 80 D, or from about 30 D to about 70 D, or from about 40 D to about 60 D, or of about 50 D. The filaments of the first yarn 104 can be man-made filaments. The man-made filaments can comprise or consist of nylon filaments, regenerated cellulosic filaments, polyester filaments, or any blend of nylon filaments, regenerated cellulosic filaments, and polyester filaments. The first yarn 104 can comprise one or more types of fibers blended with the filaments or can include one or more ends composed of fibers combined with one or ends composed of the filaments. The one or more fibers can comprise or consist of natural fibers, including cotton, wool, or a combination thereof. The first yarn 104 can be a non-elasticated yarn, meaning that it does not include any elasticated fibers or filaments, such as elastane fibers, and is not able to stretch at least 100% of its initial length without breaking, or does not spontaneously recover when stretched 100% in length. With the exception of the liner mass density per filament (e.g., dpf) of the filaments, one or more properties of the first yarn comprising filaments having an average dpf of greater than 0.8 can be similar to or the same as those described below in reference to fine filament first yarns 104. Combining a first yarn 104 consisting of a plurality of filaments having an average dpf greater than 0.8 with a second yarn 106 that is an elasticated yarn comprising an elastomeric material having a lower hysteresis than conventional elastane material, such as a bare (i.e., unwrapped or uncoated) elasticated yarn, including a single filament bare elasticated yarn, can facilitate the formation and retention of the unique knitted loop shape or can further facilitate improvement of directional stretch properties or textile stretch properties or can facilitate both in the disclosed interlock knit textile 400.

In the aspect in which the disclosed interlock knit textiles 400 include the second structural property of the first yarn 104 comprising or consisting of fine filaments, the fine filaments can have an average dpf of 0.8 or less. It has been found that using a first yarn 104 comprising or consisting of fine filaments in the disclosed interlock knit textiles 400 can result in the textiles exhibiting improved stretch properties as compared to conventional interlock knit textiles 200. Without being bound by theory, it is believed that the use of fine filaments in the first yarn 104 can reduce the degree to which the wales 408 of the interlock knit structure inhibit or limit stretch in the length direction. The use of fine filaments in the first yarn 104 may also contribute to formation and retention of the unique knitted loop shape. The fine filaments of the first yarn 104 can have an average dpf of 0.8 or less. The fine filaments of the first yarn 104 can have an average dpf of 0.7 or less. The fine filaments of the first yarn 104 can have an average dpf of 0.6 or less. The fine filaments of the first yarn 104 can have an average dpf of 0.5 or less. The fine filaments of the first yarn 104 can have an average dpf of about 0.5. The first yarn 104 can have a linear mass density of from about 20 D to about 80 D. The first yarn 104 can have a linear mass density of from about 30 D to about 70 D. The first yarn 104 can have a linear mass density of from about 40 D to about 60 D. The first yarn 104 can have a linear mass density of about 50 D.

The fine filaments of the first yarn 104 can be man-made filaments. The man-made filaments can have an average dpf of 0.8 or less, or of 0.7 or less, or of 0.6 or less, or of 0.5 or less, or of about 0.5. The man-made filaments can comprise or consist of nylon filaments, regenerated cellulosic filaments, polyester filaments, or any blend of nylon filaments, regenerated cellulosic filaments, and polyester filaments. The fine filaments of the first yarn 104 can comprise or consist of nylon filaments. The polymeric component of the nylon filaments can comprise or consist of a nylon polymer or can comprise or consist of a blend of two or more polymers including at least one nylon polymer, or can comprise or consist of a blend of two or more nylon polymers. The nylon polymer can be nylon 6, nylon 66, nylon 11, nylon 12, nylon 610, nylon 612, or any combination thereof. The fine filaments of the first yarn 104 can comprise or consist of regenerated cellulosic filaments. The regenerated cellulosic material of the regenerated cellulosic fibers can comprise or consist of viscose, lyocell, modal, cupro, rayon, acetate, or any combination thereof. The fine filaments can comprise or consist of polyester filaments. The polymeric component of the polyester filaments can comprise or consist of a polyester homopolymer, a polyester copolymer, or any combination thereof. The polyester can include a polyethylene terephthalate (PET) homopolymer or copolymer, a polybutylene terephthalate (PBT) homopolymer or copolymer, a polyethylene naphthalate (PEN) homopolymer or copolymer, a polytrimethylene terephthalate (PTT) homopolymer or copolymer, a poly(ethylene 2,5-furandicarboylate (PEF) homopolymer or copolymer, or any combination thereof. The filaments of the first yarn 104 can comprise or consist of a blend of two or more man-made filaments chosen from nylon filaments, regenerated cellulosic filaments, and polyester filaments. In one aspect, the first yarn 104 consists of the fine filaments. The first yarn 104 can consist of fine nylon filaments, fine regenerated cellulosic filaments, fine polyester filaments, or any combination thereof. The first yarn 104 can consist of fine nylon filaments. The first yarn 104 can consist of fine regenerated cellulosic filaments. The first yarn can consist of fine polyester filaments. The first yarn 104 can be a non-elasticated yarn consisting of a plurality of filaments chosen from polyester filaments, nylon filaments, regenerated cellulosic filaments, and any combination thereof, and the plurality of filaments have an average dpf of 0.6 or less.

In one aspect, the first yarn 104 can comprise one or more types of fibers blended with the filaments or can include one or more ends composed of fibers combined with one or ends composed of the filaments. The one or more fibers can comprise or consist of natural fibers, including cotton, wool, or a combination thereof. The first yarn 104 can be a non-elasticated yarn, meaning that it does not include any elasticated fibers or filaments, such as elastane fibers, and is not able to stretch at least 100% of its initial length without breaking, or does not spontaneously recover when stretched 100% in length. Combining a first yarn 104 comprising the fine filaments with a second yarn 106 that is an elasticated yarn, such as a bare (i.e., unwrapped or uncoated) elasticated yarn, including a single filament bare elasticated yarn, can further facilitate the formation and retention of the unique knitted loop shape or can further facilitate improvement of directional stretch properties or textile stretch properties or both of the disclosed interlock knit textile 400 or can further facilitate formation and retention of the unique knitted loop shape and the improved stretch properties. In one aspect, the first yarn 104 consists of fine filaments having a dpf of 0.6 or less, and the second yarn 106 consists of a 60 D to 80 D bare single filament elasticated yarn.

As described above, in one aspect, the disclosed interlock knitted textiles 400 can comprise one or more of three specific structural properties, a third of which is a second yarn 106 comprising or consisting of an elastomeric material having a lower hysteresis than conventional elastane material. In another aspect, when the disclosed interlock knitted textile 400 comprises the unique knitted loop shape or comprises a fine filament first yarn 104 or comprises both the unique knitted loop shape and the fine filament first yarn 104, the second yarn 106 can comprise or consist of a conventional elastane material. In either of these aspects, the second yarn 106 comprises or consist of an elastomeric material, and is an elasticated yarn.

In the aspect where the second yarn 106 comprises a conventional elastomeric material, the conventional elastomeric material can be an elastane material (i.e., spandex). In this aspect, the second yarn 106 is referred to as a conventional second yarn 106. The conventional second yarn 106 can be a bare elasticated yarn, such as a bare single filament or multifilament elastane yarn. The conventional second yarn 106 can be a covered yarn, such as a yarn comprising an elastomeric yarn or filament wrapped with a third yarn. The third yarn can be an elasticated yarn or a non-elasticated yarn. The non-elasticated third yarn can comprise man-made fibers or filaments, natural fibers or filaments, or any combination thereof. The conventional second yarn 106 can have a linear mass density ranging from 50 D to 150 D. The conventional second yarn 106 can have a liner mass density ranging from 50 D to 100 D. The conventional second yarn 106 can have a linear mass density ranging from 60 D to 80 D. The conventional second yarn 106 can have a linear mass density of about 70 D.

In one aspect, the second yarn 106 comprises or consists of an elastomeric material having a lower hysteresis than conventional elastane material. In another aspect, the second yarn 106 or comprises or consists of an elasticated yarn having a lower hysteresis than a conventional elastane yarn of the same linear mass density and construction. When elastomeric materials (including elasticated yarns) are stretched and then allowed to relax, the energy input into the material to stretch it (the loading curve) and the energy output from the material as it relaxes (the unloading curve) can be graphed as a hysteresis loop by plotting the stress applied on one axis (typically the y axis) and the strain measured on the other axis (typically the x axis). It is common to plot the load applied (e.g., in grams force) against the amount of elongation (e.g., percent elongation). The hysteresis loops for different elastomer materials can be plotted on the same graph to compare how the materials behave over the entire stress-strain cycle and during different portions of the stress-strain cycle. The distance between the loading curve and unloading curve for a material is reflective of the rate at which a material returns to its original state after being stretched and the stretching force released. An elastomeric material having a narrower hysteresis loop dissipates less energy over the stress-strain cycle and so can be said to exhibit less energy loss as compared to another elastomeric material having a wider hysteresis loop. If a property of a first elastomeric material is to slowly return to its original state, the distance between the loading curve and the unloading curve will be relatively large and the hysteresis loop will be relatively wide. If a stretch property of a second elastomeric material is to return to its original state more rapidly than the first material, the unloading curve of the second will be below its loading curve (as it is in the first material), but the unloading curve will be closer to the loading curve, and the hysteresis loop for the second material will be narrower than the hysteresis loop of the first material. In one aspect, the second yarn 106 comprises or consists of an elastomeric material having a narrower hysteresis loop than a conventional elastane material. The hysteresis loop for the low hysteresis elastomeric material or the second yarn 106 at least 5% narrower, or at least 10% narrower, or at least 15% narrower, or at least 20% narrower, or at least 25% narrower than the hysteresis loop for the conventional elastane material or the conventional elastane yarn. In another aspect, the second yarn 106 is an elasticated yarn having a narrower hysteresis loop than a conventional elastane yarn of the same size and construction. The relative heights of the loading and unloading curves for different elastomer materials when subjected to the same level of stress or strain can also be compared. When a first material requires greater force to achieve a given level of elongation than the amount of force required for a second material to achieve the same level of elongation, the first material can be said to have a higher hysteresis relative to the second material, and the second material can be said to have a lower hysteresis relative to the first material. In another aspect, the second yarn 106 comprises or consists of an elastomeric material requiring less force to achieve a level of elongation than conventional elastane material requires to achieve the level of elongation. In another aspect, the second yarn 106 requires less force to achieve a level of elongation than a conventional elastane yarn requires to achieve the same level of elongation. The lower force required for the lower hysteresis elastomeric material or the second yarn 106 can be at least 5% less, or at least 10% less, or at least 15% less, or at least 20% less, or at least 25% less than for the conventional elastane material or the conventional elastane yarn. When a first material exhibits a lower level of elongation when a force is applied to it and a second material exhibits a greater level elongation when the same force is applied to it, the first material can be said to have a higher hysteresis relative to the second material, and the second material can be said to have a lower hysteresis relative to the first material. In another aspect, the second yarn 106 comprises or consists of an elastomeric material exhibiting a greater level of elongation when a force is applied to it than conventional elastane material exhibits when the same force is applied to it. In yet another aspect, the second yarn 106 exhibits a greater level of elongation when a force is applied to it than a conventional elastane yarn exhibits when the same force is applied to it. The greater level of elongation of the lower hysteresis elastomeric material or the second yarn 106 can be at least 5% greater, or at least 10% greater, or at least 15% greater, or at least 20% greater, or at least 25% greater than for the conventional elastane material or the conventional elastane yarn.

The elastomeric material having a lower hysteresis than a conventional elastane material can have improved stretchability or improved recovery or both improved stretchability and recovery as compared to conventional elastane material (e.g., spandex). The second yarn 106 comprising the lower hysteresis elastomeric material can have improved stretchability or improved recovery or both improved stretchability and recovery as compared to a conventional elastane yarn (e.g., a spandex yarn) of the same size and construction. In one aspect, the lower hysteresis material or yarn requires less force to stretch as a conventional elastane material or yarn, and the lower hysteresis material or yarn can have the ability to stretch and recover than the conventional elastane material or yarn. The lower hysteresis material or yarn can have an average percent elongation which is greater than the average percent elongation of the conventional material or yarn. In one aspect, the average percent elongation of the lower hysteresis material or yarn can be 5% greater, or 10% greater, or 15% greater, or 20% greater, or 25% greater than the average percent elongation of the conventional elastane material or yarn. In another aspect, the average elastic modulus at 30% extension of the lower hysteresis material or yarn can be 5% less, or 10%, or 15% less, or 20% less, or 25% less than the average percent elongation of the conventional elastane material or yarn. The average elastic modulus at 50% extension of the lower hysteresis material or yarn can be 5% less, or 10%, or 15% less, or 20% less, or 25% less than the average percent elongation of the conventional elastane material or yarn. The average elastic modulus at 80% extension of the lower hysteresis material or yarn can be 5% less, or 10%, or 15% less, or 20% less, or 25% less than the average percent elongation of the conventional elastane material or yarn.

The second yarn 106 can have a lower hysteresis than a convention elastane yarn of the same size (e.g., the same linear mass density, the same liner mass density per filament) and same construction (e.g., the same number of filaments or end, both are bare yarns or wrapped yarns, if both are wrapped they are both wrapped with the same type of wrapping yarn, etc.). The second yarn 106 can be a bare elasticated yarn, such as a bare single filament or multifilament elastane yarn. The second yarn 106 can be a covered yarn, such as a yarn comprising an elastomeric yarn or filament wrapped with a third yarn. The third yarn can be an elasticated yarn or a non-elasticated yarn. The non-elasticated third yarn can comprise man-made fibers or filaments, natural fibers or filaments, or any combination thereof. The second yarn 106 can have a linear mass density ranging from 50 D to 150 D. The second yarn 106 can have a liner mass density ranging from 50 D to 100 D. The second yarn 106 can have a linear mass density ranging from 60 D to 80 D. The second yarn 106 can have a linear mass density of about 70 D.

In one aspect, the elastomeric material of the second yarn 106 is an elastomeric material having a lower hysteresis as compared to conventional elastane. A polymeric elastomer material can be described as having a polymeric component consisting of all the polymers present in the material. Elastane materials are polymeric elastomeric materials having a polymeric component comprising or consisting of polyether-polyurea block copolymers. In one aspect, the polymeric component of the elastomeric material of the second yarn can comprise or consist of a blend of conventional elastane (i.e., a polyether-polyurea block copolymer) with one or more additional polymers, or can comprise or consist of conventional elastane (i.e., a polyether-polyurea block copolymer) functionalized with one or more additional polymers. The blend of conventional elastane with one or more additional polymers can comprise a blend of conventional elastane with a nylon. LYCRA ΔDAPTIV materials and yarns, manufactured by The LYCRA Company (Wilmington, DE, USA), are examples of materials and yarns having lower hysteresis and improved stretchability and/or recovery as compared to conventional elastane materials and yarns.

Many different types of articles incorporate knit textiles into their construction due to the ability of knit textiles to stretch or cling. For example, many articles of apparel are designed to fit closely to or cling to the body of a wearer. Often textiles having stretch properties are used in articles of apparel, such as sports articles of apparel, as textiles having stretch properties can provide a level of cling or compression to the body of a wearer, for example to a particular area or part of the body, such as an upper torso or a lower torso.

Elasticity generally refers to the ability of a material to stretch and then return to its original shape and size when the stretching force is removed. Textiles, including knitted textiles, can be characterized based on their elongation, modulus and relaxation properties using standard methods known in the art. One method of determining a textile's elongation (including percent elongation), modulus and relaxation properties is described in ISO 20932-1:2020+A1:2021, for example, using Method A with an extension force of 35 Newtons.

Properties such as percent elongation and modulus are often determined in both a textile's length and width directions, which are perpendicular to each other. In knit textiles, it is common to measure directional stretch properties in the length direction by stretching the textile in the direction parallel with the courses of knit stitches and by separately measuring the directional stretch properties in the width direction by stretching the textile in a direction parallel with the wales of knit stitches, as these directional stretch properties of a textile can vary. It is common to measure the percent elongation of a textile when it is temporarily subjected to a standard stretching force, such as a 35 Newton force. A larger value for percent elongation indicates the textile stretched a greater distance, while a smaller value for percent elongation indicates the textile stretched a shorter distance. A textile's modulus is a measurement of the textile's resistance to an externally applied stretching force, and is often determined at several different strain values, such as at 10%, 30%, 50% and 80% of the maximum strain used in the test method. The larger the value of the modulus, the smaller the elastic deformation of the textile (i.e., less stretch or more stiffness) and the smaller the value of the modulus, the larger the elastic deformation of the textile (i.e., more stretch or less stiffness). Thus, textiles having a low modulus elongate or stretch more easily while textiles having a high modulus resist stretch or restrict movement to a greater extent.

In conventional interlock knit textiles, the width direction percent elongation determined by stretching the knit textile in the direction parallel with the wales of the knit structure is typically much greater than the length direction percent elongation determined by stretching the knit textile in the direction parallel with the courses of the knit structure. For example, in conventional interlock knit textiles, the absolute difference between a percent elongation in the width direction and a percent elongation in the length direction is typically greater than 80 percentage points, such as greater than 90 percentage points or greater than 100 percentage points. Similarly, in conventional interlock knit textiles, the absolute difference between a width direction modulus and a length direction modulus at 50% strain or at 80% strain is typically greater than 100 grams force (gf), or greater than 200 gf, or greater than 300 gf, or greater than 400 gf.

In one aspect, the disclosed interlock knit textile is an interlock knit textile having a smaller absolute difference between a width direction average percent elongation and a length direction average percent elongation than is observed for conventional interlock knit textiles. For example, an absolute difference between the width direction average percent elongation and the length direction average percent elongation of the disclosed interlock knit textile can be less than 70 percentage points. The absolute difference can be less than 60 percentage points. The absolute difference can be less than 50 percentage points. The absolute difference can be less than 40 percentage points. In another aspect, the disclosed interlock knit textile is an interlock knit textile having a smaller absolute difference between a width direction average modulus and length direction average modulus as compared to a conventional interlock knit textile. For the disclosed interlock knit textile, an absolute difference between the width direction and length direction average moduli can be measured at 10% strain, or at 30% strain, or at 50% strain, or at 80% strain, or at any combination thereof. The absolute difference between the width direction and length direction average moduli can be measured at 50% strain or at 80% strain. For a disclosed interlock knit textile, the absolute difference between the width direction modulus and the length direction modulus at 50% strain or at 80% strain can be less than 70 gf. The absolute difference between the width direction modulus and the length direction modulus can be less than 60 gf. The absolute difference between the width direction modulus and the length direction modulus can be less than 50 gf. The absolute difference between the width direction modulus and the length direction modulus can be less than 40 gf.

TABLE 2

| | Conventional Interlock Knit Textile 1600 | | | Disclosed Interlock Knit Textile 1700 Example A | | | Disclosed Interlock Knit Textile 1800 Example B | | |
|---|---|---|---|---|---|---|---|---|---|
| | Width | Length | Diff. | Width | Length | Diff. | Width | Length | Diff. |
| % Elongation | 227 | 122 | 105 | 203 | 164 | 39 | 198 | 148 | 50 |
| Modulus (gf) | | | | | | | | | |
| at 10% strain | 2 | 30 | 28 | — | — | — | 1 | 7 | 6 |
| at 30% strain | 91 | 231 | 140 | 12 | 168 | 156 | 136 | 180 | 44 |
| at 50% strain | 223 | 416 | 193 | 249 | 276 | 27 | 264 | 294 | 30 |
| at 80% strain | 410 | 884 | 474 | 418 | 442 | 24 | 452 | 494 | 42 |

Determined using ISO 20932-1: 2020 + A1: 2021(Modified); Method A, Ext. load: 35N In Table 2, "Width" refers to a property measured when the textile is stretched in the width direction, which is parallel to the wales of the knit structure, "Length" refers to a property measured when the textile is stretched in the length direction, which is parallel to the courses of the knit structure and perpendicular to the width direction, and "Diff" refers to the absolute value of the difference between the value of the property in the width direction and the value of the property in the length direction. The conventional interlock knit textile 1600 was knit using a first 50-75 D multifilament nylon yarn having a dpf of greater than 0.6 and a second 20-30 D single filament bare elastane yarn. The knit gauge of the conventional interlock knit textile is 24-28, and the conventional interlock knit textile has a fabric weight of 180 to 250 grams per square meter. Disclosed interlock knit textiles 1700 and 1800 were knit on a double needle interlock knit machine using a first 40D-60D multifilament nylon yarn having a dpf of less than 0.5 and a second 60-80 D single filament bare elasticated LYCRA ΔDAPTIV yarn. The knit gauge of disclosed interlock knit textile 1700 is 32 . . . . The knit gauge of disclosed interlock knit textile 1800 is 40.

In Example A of Table 2, the average percent elongation in the width direction (i.e., the width direction average percent elongation) of disclosed interlock knit textile 1700 is 203%, the average percent elongation in the length direction (i.e., the length direction average percent elongation) of disclosed interlock knitted textile is 164%, and an absolute value of the difference between the width direction average percent elongation and the length direction average percent elongation is 39 percentage points. For the conventional interlock knit textile 1600, the width direction average percent elongation is 227%, the length direction average percent elongation is 122%, and an absolute value of the difference between two is 105 percentage points. In this example, disclosed interlock knit textile 1700 has a width direction average percent elongation which is somewhat less than for conventional interlock knit textile 1600 (203% as compared to 227%), the length direction average percent elongation for disclosed interlock knit textile 1700 is somewhat greater than for the conventional interlock knit textile 1600 (164% as compared to 122%), and the absolute difference between the percent elongations for disclosed interlock knit textile 1700 and for the conventional interlock knit textile 1600 is significantly different (39 percentage points as compared to 105 percentage points), with the difference for the conventional interlock knit textile 1700 being more than 2.5 times greater than the difference for disclosed interlock knit textile 1700.

In Example B in Table 2, the width direction average percent elongation of disclosed interlock knitted textile 800 is 198%, the length direction average percent elongation is 148%, and an absolute value of the difference between the width direction average width percent elongation and the length direction average percent elongation is 60 percentage points. For the conventional interlock knitted textile 1600, the width direction average percent elongation is 227%, the length direction average percent elongation is 122%, and an absolute value of the difference between the width direction average percent elongation and the length direction average percent elongation is 105 percentage points. In this example, disclosed interlock knitted textile 1800 has a width direction average percent elongation that is somewhat less than in the conventional interlock knitted textile 1600 (198% as compared to 227%), the length direction average percent elongation for disclosed interlock textile 1800 is somewhat greater than in the conventional interlock knit textile 1600 (148% as compared to 122%), and the absolute difference between the width direction average percent elongation and the length direction average width percent elongation for disclosed interlock knit textile 1800 and for the conventional interlock knit textile 1600 are significantly different (60 percentage points as compared to 105 percentage points), with the difference for the conventional interlock knit textile 1600 being about 1.75 greater than the difference for disclosed interlock knit textile 1800.

The elastic moduli observed in the width and length directions for the Examples A and B of disclosed interlock knit textiles 1700 and 1800 follow the same trend observed for percent elongation, as the absolute difference between the average elastic moduli measured for the disclosed interlock knit textiles 1700 and 1800 in the length and width directions is much smaller than for the conventional interlock knit textile 1600, particularly for measurements taken at 50% and 80% strain. For the conventional interlock knit textile 1600, the absolute difference between the width direction average moduli and length direction average elastic moduli at 50% strain is 193 grams force (gf), and at 80% strain is 474 gf. In comparison, for disclosed interlock knit textile 1700 (Example A), the absolute difference at 50% strain is 27 gf, and at 80% strain is 24 gf. For disclosed interlock knit textile 1800 (Example B), the absolute difference at 50% strain is 30 gf, and at 80% strain is 42 gf.

Figure 13B:
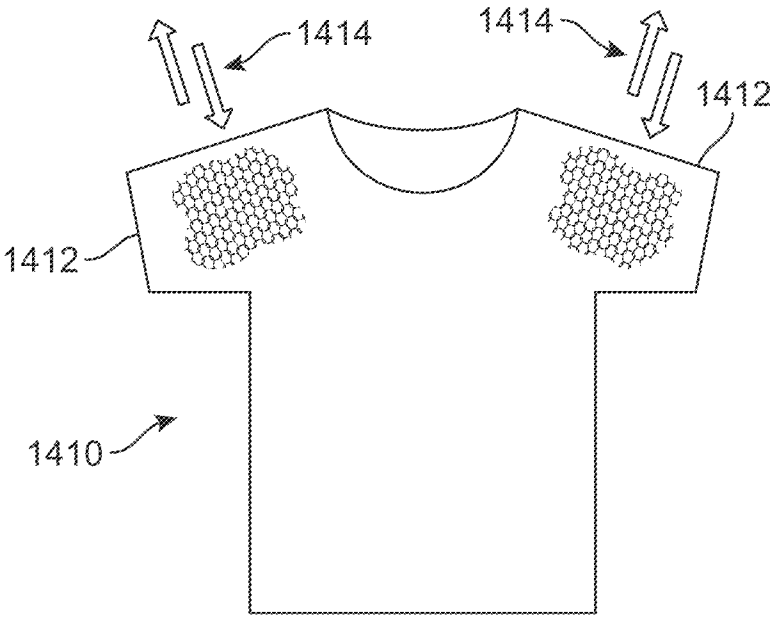
FIG. 13B is a representative view of an example of an article of apparel made of an interlock knit textile in accordance with the present disclosure in the form of a shirt.
Figure 13A:
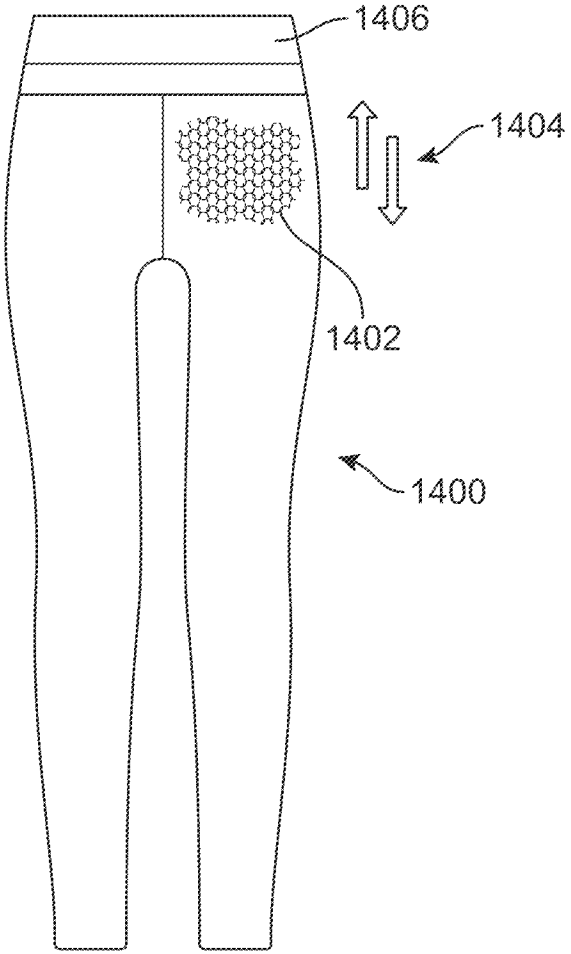
FIG. 13A is a representative view of an example of an article of apparel made of an interlock knit textile in accordance with the present disclosure in the form of a pair of leggings.

Different types of articles, including apparel, can incorporate a disclosed interlock knit textile. FIGS. 13A and 13B illustrate different types of articles of apparel that can comprise a disclosed interlock knit textile for all or one or more part of the article. Referring first to FIG. 13A, an article of apparel made of the disclosed interlock knit textile is illustrated in the form of an article of apparel configured to cover at least a lower torso of a wearer, specifically a pair of leggings 1400. Leggings 1400 can include at least one area 1402 incorporating a disclosed interlock knit textile. The disclosed interlock knit textile can be incorporated into leggings 1400. Optionally, the disclosed interlock knit textile may be oriented so that a direction with greater stretch 1404 (i.e., the width direction or the length direction) is aligned in a direction along the length of leggings 1400. The disclosed interlock knit textile can be incorporated into at least a portion of a waistband 1406 of the leggings 1400, or into a lower waist area of the leggings 1400, or into a seat area of the leggings 1400, or into any combination thereof. With this arrangement, leggings 1400, at least at area 1402, can have greater stretch in a vertical stretch direction 1404 to provide the wearer with a more comfortable feel, fit and freedom during movement. Alternatively, due to the improved stretch properties of the disclosed interlock knit textiles, the directional stretch properties of the disclosed interlock knit textile do not need to be considered when placing the disclosed interlock knit textiles in an article. The portion of the leggings 1400 including the disclosed interlock knit textile can also provide targeted compression to the corresponding area of the leggings 1400. Including the disclosed interlock knit textile in an article of apparel configured for wear on a lower torso, including in at least a portion of waistband 1406 of an article of apparel, such as at least a back waistband portion, has been found to improve resistance to the waistband 1406 rolling and/or to riding up or down on the body of a wearer of the article of apparel during wear when the wearer performed physical activities.

Referring next to FIG. 13B, an article of apparel configured to cover at least a portion of an upper torso and/or arms of a wearer is shown. In this example, the article of apparel comprises at least a portion of the disclosed interlock knit textile, and is shown in the form of a shirt 1410. Shirt 1410 includes at least areas 1412 incorporating a disclosed interlock knit textile. Areas 1412 including the disclosed interlock knit textile can include the sleeves of shirt 1410. Areas 1412 can include the disclosed interlock knit textile. Optionally, the interlock knit textile may be oriented so that a direction of greatest stretch (i.e., the width direction or the length direction) is aligned in a direction that allows the sleeves to have an improved stretch around the arms of a wearer of shirt 1410. This can allow greater stretch of the sleeves when a wearer of shirt 1410 flexes their biceps, and the sleeves can provide the wearer with a more comfortable feel and fit around their arms. Alternatively, due to the improved stretch properties of the disclosed interlock knit textiles, the directional stretch properties of the disclosed interlock knit textile do not need to be considered when placing the disclosed interlock knit textiles in an article.

The examples of articles of apparel or garments shown in FIGS. 13A and 13B should not be considered limiting. Other types or forms of articles of apparel, clothing, or garments can be made from an interlock knit textile formed in accordance with the techniques of the disclosure as would be obvious to one of ordinary skill in the art in view of the present teachings, including, but not limited to shirts, headwear, coats, jackets, pants, underwear, gloves, socks, and footwear. Additionally, as described above, an interlock knit textile formed in accordance with the techniques of the disclosure can also be used for other industries other than apparel, clothing, or garments.

While various aspects of the disclosure have been described, the description is intended to be exemplary, rather than limiting and it will be apparent to those of ordinary skill in the art that many more aspects and implementations are possible that are within the scope of the disclosure. Accordingly, the disclosure is not to be restricted except in light of the attached claims and their equivalents. Also, various modifications and changes can be made within the scope of the attached claims.

Selected Aspects and Claim Concepts

A0. An interlock knit textile comprising:

a first yarn and a second yarn knit together in an interlock knit structure, wherein the first yarn is a multifilament yarn, the second yarn is an elasticated yarn, and the interlock knit textile includes at least one structural property chosen from a) a plurality of knitted loops in the interlock knit structure have an average loop distance ratio of less than 0.85, b) the first yarn is a multifilament yarn comprising or consisting of filaments having an average denier per filament (dpf) of 0.8 or less, and c) the second yarn is an elasticated yarn comprising or consisting of an elastomeric material having a lower hysteresis than conventional elastane, or is an elasticated yarn having a lower hysteresis than a conventional elastane yarn of the same size and construction.

A1. The interlock knit textile according to aspect A0, wherein the interlock knit textile includes at least two of the structural properties chosen from a), b) and c).

A2. The interlock knit textile according to aspect A0 or A1, wherein the interlock knit textile includes each of the structural properties a), b) and c).

A3. The interlock knit textile according to any one of aspects A0 to A2, wherein the first yarn is a non-elasticated yarn.

A4. The interlock knit textile according to any one of aspects A0 to A3, wherein the interlock knit textile exhibits stretch properties including length direction properties determined by stretching the interlock knit textile in a length direction parallel with the knit courses in the interlock knit structure of the knit textile and width direction properties determined by stretching the interlock knit textile in a width direction parallel with wales in the interlock knit structure of the interlock knit textile, and the exhibited stretch properties include least one textile stretch property chosen from d) the interlock knit textile has a length direction average percent elongation, a width direction average percent elongation, and an absolute value of a difference between the length direction average percent elongation and the width direction average percent elongation is less than 70 percentage points;

e) the interlock knit textile has a length direction average modulus at 50% strain, a width direction average modulus at 50% strain, and an absolute value of a difference between the length direction average modulus at 50% strain and the width direction average modulus at 50% strain is less than 70 grams force (gf); and f) the interlock textile has a length direction average modulus at 80% strain, a width direction average modulus at 80% strain, and an absolute value of a difference between the length direction average modulus at 80% strain and the width direction average modulus at 80% strain is less than 70 gf.

A5. The interlock knit textile according to any one of aspects A0 to A4, wherein the interlock knit textile includes at least two of the textile stretch properties chosen from d), e) and f).

A6. The interlock knit textile according to any one of aspects A0 to A5, wherein the interlock knit textile includes each of the textile stretch properties d), e) and f).

A7. The interlock knit textile according to any one of aspects A0 to A6, wherein the interlock knit textile includes the structural property a) the plurality of knitted loops have the average loop distance ratio of less than 0.85; optionally wherein the average loop distance ratio is less than 0.83, or the average loop distance ratio is less than 0.80, or the average loop distance ratio is about 0.78.

A8. The interlock knit textile according to any one of aspects A0 to A7, wherein the plurality of loops includes at least 10% of knitted loops in the interlock knit structure, or includes at least 25% of knitted loops in the interlock knit structure, or includes at least 50% of knitted loops in the interlock knit structure, or includes a majority of knitted loops in the interlock knit structure, or includes at least 75% of knitted loops in the interlock knit structure, or includes all knitted loops in the interlock knit structure.

A9. The interlock knit textile according to any one of aspects A0 to A8, wherein the interlock knit textile comprises at least two knit courses having the interlock knit structure, or comprises at least five knit courses having the interlock knit structure, or at least 10% of all knit courses in the interlock knit textile each have the interlock knit structure, or at least 25% of all knit courses in the interlock knit textile each have the interlock knit structure, or at least 50% of all knit courses in the interlock knit textile each have the interlock knit structure, or at least 75% of all knit courses in the interlock knit textile each have the interlock knit structure, or at least 95% of all knit courses in the interlock knit textile each have the interlock knit structure, or all knit courses in the interlock knit textile each have the interlock knit structure.

A10. The interlock knit textile according to any one of aspects A0 to A9, wherein the interlock knit textile includes the structural property b) the first yarn comprises or consists of the filaments having the average denier per filament (dpf) of 0.8 or less; optionally wherein the filaments have an average dpf of 0.7 or less, or have an average dpf of 0.6 or less, or have an average dpf of 0.5 or less, or have a average dpf of about 0.5.

A11. The interlock knit textile according to any one of aspects A0 to A10, wherein the filaments of the first yarn comprise or consists of polyester filaments, nylon filaments, regenerated cellulose filaments, or any combination thereof; optionally wherein the filaments of the first yarn comprise or consist of nylon filaments, regenerated cellulose filaments, or any combination thereof; optionally wherein the filaments of the first yarn comprise or consist of nylon filaments; optionally wherein the filaments of the first yarn consist of nylon filaments; optionally wherein the first yarn is free of natural fibers; optionally wherein the first yarn is a non-elasticated yarn.

A12. The interlock knit textile according to any one of aspects A0 to A11, wherein the first yarn further comprises natural fibers or filaments; optionally wherein the natural fibers comprise or consist of cotton fibers, or comprise or consist of wool fibers, or comprise or consist of silk filaments, or comprise or consist of any combination thereof.

A13. The interlock knit textile according to any one of aspects A0 to A12, wherein the first yarn has a linear mass density ranging from about 20 denier (D) to about 80 D, or has a linear mass density ranging from about 30 D to about 70 D, or has a linear mass density ranging from about 40 D to about 60 D, or has a linear mass density of about 50 D.

A14. The interlock knit textile according to any one of aspects A0 to A13, wherein the filaments of the first yarn comprise or consist of nylon filaments; optionally wherein the first yarn further comprises non-nylon fibers or filaments; optionally wherein the first yarn comprises or consists of nylon filaments in combination with cotton fibers, or comprises or consists of nylon filaments in combination with regenerated cellulose filaments.

A15. The interlock knit textile according to any one of aspects A0 to A14, wherein the interlock knit textile includes c) the second yarn is an elasticated yarn comprising or consisting of an elastomeric material having a lower hysteresis than conventional elastane or is an elasticated yarn having a lower hysteresis than a conventional elastane yarn of the same size and construction; optionally wherein the lower hysteresis comprises a stretch property that is at least 5% lower, or at least 10% lower, or at least 15% lower, or at least 20% lower, or at least 25% lower than the stretch property for the conventional elastane material or the conventional elastane yarn.

A16. The interlock knit textile according to any one of aspects A0 to A15, wherein the second yarn is an elasticated yarn having a hysteresis at least 5% lower than a hysteresis of a conventional elastane yarn of the same denier and structure as the second elasticated yarn; optionally wherein the hysteresis of the second yarn is at least 10% lower or is at least 15% lower or is at least 20% lower or is at least 25% lower than a conventional elastane yarn of the same denier and structure.

A17. The interlock knit textile according to any one of aspects A0 to A16, wherein the second yarn has a linear mass density ranging from about 50 D to about 150 D, or has a linear mass density ranging from about 50 D to about 100 D, or has a linear mass density ranging from about 60 D to about 80 D, or has a linear mass density of about 50 D.

A18. The interlock knit textile according to any one of aspects A0 to A17, wherein the second yarn is a single-filament bare elasticated yarn, or wherein the second yarn is a single-filament wrapped elasticated yarn, or wherein the second yarn is a multiple-filament wrapped elasticated yarn.

A19. The interlock knit textile according to any one of aspects A0 to A18, wherein a polymeric component of the elastomeric material of the second yarn comprises or consists of a blend of conventional elastane with one or more additional polymers; optionally wherein the polymeric component has greater stretchability, or has greater recovery, or has both greater stretchability and recovery as compared to conventional elastane without the one or more additional polymers; optionally wherein the blend of conventional elastane with one or more additional polymers comprises a blend of conventional elastane with a nylon.

A20. The interlock knit textile according to any one of aspects A0 to A19, wherein the lower hysteresis elastomeric material or yarn comprising the lower hysteresis material exhibits at least one stretch property chosen from: g) an average percent elongation of the lower hysteresis material or yarn comprising the lower hysteresis material is 5% greater, or 10% greater, or 15% greater, or 20% greater, or 25% greater than an average percent elongation of the conventional elastane material or of the conventional elastane yarn; h) an average elastic modulus at 30% extension of the lower hysteresis material or yarn comprising the lower hysteresis material is 5% less, or 10%, or 15% less, or 20% less, or 25% less than an average percent elongation of the conventional elastane material or of the conventional elastane yarn; i) an average elastic modulus at 50% extension of the lower hysteresis material or yarn comprising the lower hysteresis material is 5% less, or 10%, or 15% less, or 20% less, or 25% less than an average percent elongation of the conventional elastane material or conventional elastane yarn; and j) an average elastic modulus at 80% extension of the lower hysteresis material or yarn comprising the lower hysteresis material is 5% less, or 10%, or 15% less, or 20% less, or 25% less than the average percent elongation of the conventional elastane material or conventional elastane yarn; optionally wherein the lower hysteresis elastomeric material or yarn comprising the lower hysteresis material exhibits at least two stretch properties chosen from g), h), i) and j); or exhibits at least three stretch properties chosen from g), h), i) and j); or exhibits all four of stretch properties g), h), i) and j).

A21. The interlock knit textile according to any one of aspects A0 to A20, wherein the first yarn comprises or consists of nylon filaments or comprises or consists of a blend of nylon filaments with non-nylon fibers or filaments, and the second yarn comprises or consists of an elastomeric filament having a polymeric component consisting of a blend of conventional elastane with a second polymer.

A22. The interlock knit textile according to any one of aspects A4 to A21, wherein the interlock knit textile includes the stretch property d) the length direction has the average percent elongation, the width direction has the average percent elongation, and the absolute value of the difference between the length direction average percent elongation and the width direction average percent elongation is less than 70 percentage points; optionally wherein the absolute value of the difference is less than 60 percentage points, or the absolute value of the difference is less than 50 percentage points, or the absolute value of the difference is less than 40 percentage points, or is less than 30 percentage points.

A23. The interlock knit textile according to any of aspects A4 to A22, wherein the average percent elongation of the interlock knit textile in the length direction and in the width direction are both at least 120%, or are both at least 140%, or are both at least 150%, or are both at least 160%.

A24. The interlock knit textile according to any one of aspects A4 to A23, wherein the interlock knit textile includes the stretch property e) the length direction has the average modulus at 50% strain, the width direction has the average modulus at 50% strain, and the absolute value of the difference between the length direction average modulus at 50% strain and the width direction average modulus at 50% strain is less than 70 grams force (gf); optionally wherein the absolute value of the difference is less than 60 gf, or the absolute value of the difference is less than 50 gf, or the absolute value of the difference is less than 40 gf, or the absolute value of the difference is less than 30 gf.

A25. The interlock knit textile according to any one of aspects A4 to A24, wherein the interlock knit textile includes the stretch property f) the length direction has the average modulus at 80% strain, the width direction has the average modulus at 80% strain, and the absolute value of the difference between the length direction average modulus at 80% strain and the width direction average modulus at 80% strain is less than 70 gf; optionally wherein the absolute value of the difference is less than 60 gf, or the absolute value of the difference is less than 50 gf, or the absolute value of the difference is less than 40 gf, or the absolute value of the difference is less than 30 gf.

A26. The interlock knit textile according to any one of aspects A0 to A25, wherein the interlock knit textile is a circular interlock knit textile.

A27. The interlock knit textile according to any one of aspects A0 to A26, wherein the interlock knit structure is a plated knit structure with the first yarn predominately defining a face surface of the interlock knit textile and the second yarn predominately defining a back surface opposing the face surface, or with the second yarn predominately defining the face surface and the first yarn predominately defining the back surface, or with the first yarn predominately defining both the face surface and the back surface.

A28. The interlock knit textile according to any one of aspects A0 to A27, wherein a face side of the interlock knit textile is a sanded textile surface, or a back side of the interlock knit textile is a sanded textile surface, or both the face side and the back side of the interlock knit textile are sanded textile surfaces; optionally wherein the interlock knit structure a plated knit structure with the first yarn predominately defining at least one sanded textile surface.

B0. An article comprising an interlock knit textile according to any one of aspects A0 to A28.

B1. The article according to aspect B0, wherein the article is an article of apparel, an article of footwear, an article of sporting equipment, or an accessory.

B2. The article according to aspect B0 or B1, wherein the article is an article of apparel.

B3. The article according to aspect B2, wherein the article of apparel is an article of apparel configured to cover an upper torso of a wearer or a lower torso of a wearer.

B4. The article according to B2 or B3, wherein the article is an article of apparel comprising a waistband, and at least the waistband comprises the interlock knit textile.

C0. A method of manufacturing an interlock knit textile, the method comprising:

on a knitting machine, knitting a first yarn and a second yarn in an interlock knit structure to form the interlock knit textile; wherein the knitting includes at least one of a) forming knit courses of the interlock knit textile to include a plurality of knitted loops having an average loop distance ratio of less than 0.85;

b) forming knit courses of the interlock knit textile using the first yarn, wherein the first yarn comprises or consists of filaments having a denier per filament (dpf) of 0.8 or less;

c) forming knit courses of the interlock knit textile using the second elasticated yarn, wherein the second yarn comprises or consists of an elastomeric material having a lower hysteresis than conventional elastane material.

C1. The method of manufacturing of aspect C0, wherein the interlock knit textile has a length direction parallel with knit courses in the interlock knit structure, a width direction parallel with knit wales in the interlock knit textile, and the method of manufacturing results in the interlock knit textile exhibiting stretch properties including length direction stretch properties determined by stretching the interlock knit textile in the length direction and width direction stretch properties determined by stretching the interlock knit textile in the width direction, and the exhibited stretch properties comprise at least one textile stretch property chosen from d) a length direction average percent elongation, a width direction average percent elongation, and an absolute value of a difference between the length direction average percent elongation and the width direction average percent elongation is less than 70 percentage points;

e) a length direction average modulus at 50% strain, a width direction average modulus at 50% strain, and an absolute value of a difference between the length direction average modulus at 50% strain and the width direction average modulus at 50% strain is less than 70 gf; and f) a length direction average modulus at 80% strain, a width direction average modulus at 80% strain, and an absolute value of a difference between the length direction average modulus at 80% strain and the width direction average modulus at 80% strain is less than 70 gf.

C2. The method of manufacturing of aspect C0 or C1, wherein the knitting further comprises repeatedly forming additional courses in the interlock knit textile, wherein the additional courses have the interlock knit structure; optionally wherein the manufacturing further comprises plating the first yarn with the second yarn prior to the knitting.

C3. The method of manufacturing according to any one of aspects C0 to C2, further comprising, during the knitting, adjusting a tension applied to the first yarn to a range of 3 g to 5 g and adjusting a tension applied to the second yarn to a range of 4g to 6 g.

C4. The method of manufacturing of any one of aspects C0 to C3, wherein the knitting machine is a circular knitting machine, the knitting is circular knitting, and the interlock knit textile is a circular interlock knit textile.

C5. The method of manufacturing of aspect C4, wherein the circular knitting machine includes a first knit cam mechanism associated with a dial of the circular knitting machine that is configured to actuate a plurality of needles of a first needle bed and includes a second knit cam mechanism associated with a cylinder of the circular knitting machine that is configured to actuate a plurality of needles of a second needle bed; a top portion of the second knit cam mechanism associated with the cylinder is located beneath a distal end of the second needle bed; and the circular knitting comprises using the first knit cam mechanism and the second knit cam mechanism; optionally wherein the method of manufacturing further comprises locating the top portion of the second knit cam mechanism between 25 and 75 decimillimeters (dmm), or about 50 50 dmm beneath the distal end of the second needle bed prior to the circular knitting of the circular interlock knit textile.

C6. The method of manufacturing according to aspect C5, wherein the method of manufacturing further comprises, prior to or during the circular knitting, offsetting the first knit cam mechanism associated with the dial of the circular knitting machine relative to the second knit cam mechanism associated with the cylinder of the circular knitting machine by a separation distance that is greater than 3.5 needles; optionally wherein the separation distance is approximately 4.5 needles.

C7. The method of manufacturing according to any aspect C4, wherein the knitting machine is a circular knitting machine having a first knit cam mechanism associated with a dial of the circular knitting machine that is configured to actuate a plurality of needles of a first needle bed and a second knit cam mechanism associated with a cylinder of the circular knitting machine that is configured to actuate a plurality of needles of a second needle bed; and wherein the circular knitting comprises using the first knit cam mechanism and the second knit cam mechanism.

C8. The method of manufacturing according to C5, wherein the method of manufacturing further comprises, prior to or during the circular knitting, offsetting a position of the first knit cam mechanism associated with the dial of the circular knitting machine relative to a position of the second knit cam mechanism associated with the cylinder of the circular knitting machine by a separation distance greater than 3.5 needles; optionally wherein the separation distance is approximately 4.5 needles.

C9. The method of manufacturing according to aspect C5 to C8, wherein the circular knitting comprises circular knitting together the first yarn and the second yarn using the first knit cam mechanism and the second knit cam mechanism in their relative offset positions to form the circular interlock knit textile; optionally wherein the first yarn is plated with the second yarn prior to the circular knitting.

C10. The method of manufacturing according to any one of aspects C6 to C9, further comprising, prior to the circular knitting, placing a top portion of the second knit cam mechanism associated with the cylinder beneath a distal end of the second needle bed, and wherein the circular knitting comprises circular knitting a plurality of courses of the interlock knit textile with the top portion of the second knit cam mechanism located beneath the distal end of the second needle bed.

C11. The method of manufacturing according to any one of aspects C6 to C10, further comprising repeatedly forming a plurality of courses of the interlock knit structure with the circular knitting machine using the first knit cam mechanism and the second knit cam mechanism in their relative offset positions.

C12. The method of manufacturing according to any one of aspects C0 to C11, wherein the method of manufacturing further comprises sanding a face side of the interlock knit textile or sanding a back side of the interlock knit textile or sanding both the face side and the back side of the interlock knit textile.

C13. The method of manufacturing according to any one of aspects C0 to C12, wherein the interlock knit textile is an interlock knit textile according to any one of aspects A0 to A28.

D0. An interlock knit textile made according to the method of any one of aspects C0 to C13.

E0. A method of making an article, the method comprising combining an interlock knit textile according to any one of aspects A0-A28 with at least one additional component to make the article.

E1. The method of aspect E0, wherein the article is an article according to any one of aspect B0 to B4.

F0. An article made by the method of aspect E0 or E1.

The invention claimed is:

1. An interlock knit textile comprising:

a first yarn and a second yarn knit together in an interlock knit structure, wherein the first yarn is a multifilament non-elasticated yarn, the second yarn is an elasticated yarn, and the interlock knit textile includes at least one structural property chosen from a) a plurality of knitted loops in the interlock knit structure have an average loop distance ratio of less than 0.85, b) the first yarn comprises or consists of filaments having an average denier per filament (dpf) of 0.8 or less, and c) the second yarn comprises or consists of an elastomeric material having a lower hysteresis than conventional elastane;

wherein the interlock knit textile has a course direction parallel with the knit courses in the interlock knit structure, has a wale direction parallel with wales in the interlock knit textile, and has a stretch property comprising at least one of d) wherein the interlock knit textile has a length direction average percent elongation, a width direction average percent elongation, and an absolute value of a difference between the length direction average percent elongation and the width direction average percent elongation is less than 70 percentage points;

e) wherein the interlock knit textile has a length direction average modulus at 50% strain, a width direction average modulus at 50% strain, and an absolute value of a difference between the length direction average modulus at 50% strain and the width direction average modulus at 50% strain is less than 70 grams force (gf); and f) wherein the interlock textile has a length direction average modulus at 80% strain, a width direction average modulus at 80% strain, and an absolute value of a difference between the length direction average modulus at 80% strain and the width direction average modulus at 80% strain is less than 70 gf.

2. The interlock knit textile according to claim 1, wherein the first yarn is a non-elasticated yarn comprising the filaments, and the filaments have an average dpf of 0.6 or less.

3. The interlock knit textile according to claim 1, wherein the filaments of the first yarn comprise polyester filaments, nylon filaments, regenerated cellulose filaments, or any combination thereof.

4. The interlock knit textile according to claim 1, wherein the first yarn has a linear mass density ranging from about 20 denier to about 80 denier.

5. The interlock knit textile according to claim 1, wherein the second yarn has a linear mass density ranging from about 20 denier to about 80 denier.

6. The interlock knit textile according to claim 1, wherein the second yarn is a single-end bare elasticated yarn and has a hysteresis that is at least 5% lower than a hysteresis of a single-end bare elastane yarn having the same denier as the second yarn.

7. The interlock knit textile according to claim 1, wherein the first yarn is a multifilament non-elasticated yarn having a linear mass density ranging from about 40 denier (D) to about 60 D, the filaments have an average dpf of 0.6 or less, and the first yarn consists of the filaments; and wherein the second elasticated yarn consists of a single filament yarn having a linear mass density ranging from about 60 D to about 80D.

8. An article of apparel comprising the interlock knit textile according to claim 1.

9. An interlock knit textile comprising:

a first non-elasticated yarn and a second elasticated yarn knit together in an interlock knit structure, wherein the first yarn is a non-elasticated multifilament yarn, the second yarn is an elasticated yarn, and interlock knit textile includes at least two structural properties chosen from a) a plurality of knitted loops in the interlock knit structure have an average loop distance ratio of less than 0.85, b) the first yarn comprises or consists of filaments having an average denier per filament (dpf) of 0.6 or less, and c) the second yarn comprises or consists of an elastomeric material having a lower hysteresis than conventional elastane;

wherein the interlock knit textile has a length direction parallel with the knit courses in the interlock knit structure, has a width direction parallel with wales in the interlock knit textile, and has at least textile stretch property chosen from d) the interlock knit textile has a length direction average percent elongation, a width direction average percent elongation, and an absolute value of a difference between the length direction average percent elongation and the width direction average percent elongation is less than 70 percentage points;

e) the interlock knit textile has a length direction average modulus at 50% strain, a width direction average modulus at 50% strain, and an absolute value of a difference between the length direction average modulus at 50% strain and the width direction average modulus at 50% strain is less than 70 grams force (gf); and f) the interlock textile has a length direction average modulus at 80% strain, a width direction average modulus at 80% strain, and an absolute value of a difference between the length direction average modulus at 80% strain and the width direction average modulus at 80% strain is less than 70 gf.

10. The interlock knit textile according to claim 9, wherein the first non-elasticated yarn consists of the filaments having the average dpf of 0.8 or less.

11. The interlock knit textile according to claim 10, wherein the filaments of the first non-elasticated yarn comprise polyester filaments, nylon filaments, regenerated cellulose filaments, or any combination thereof.

12. The interlock knit textile according to claim 9, wherein the first non-elasticated yarn has a linear mass density ranging from about 20 denier to about 80 denier.

13. The interlock knit textile according to claim 9, wherein the second elasticated yarn has a linear mass density ranging from about 60 denier to about 80 denier.

14. The interlock knit textile according to claim 9, wherein the second elasticated yarn is a single-filament bare elasticated yarn.

15. An article of apparel comprising the interlock knit textile according to claim 9.

16. An interlock knit textile comprising:

a first yarn and a second yarn knit together in an interlock knit structure, wherein the first yarn is a non-elasticated multifilament yarn consisting of filaments having a denier per filament (dpf) of 0.5 or less, and the second yarn is a single-end bare elasticated yarn;

wherein the interlock knit textile has a length direction parallel with the knit courses in the interlock knit structure, has a width direction parallel with wales in the interlock knit textile, and has at least one textile stretch property chosen from d) the interlock knit textile has a length direction average percent elongation, a width direction average percent elongation, and an absolute value of a difference between the length direction average percent elongation and the width direction average percent elongation is less than 70 percentage points;

e) the interlock knit textile has a length direction average modulus at 50% strain, a width direction average modulus at 50% strain, and an absolute value of a difference between the length direction average modulus at 50% strain and the width direction average modulus at 50% strain is less than 70 grams force (gf); and f) the interlock textile has a length direction average modulus at 80% strain, a width direction average modulus at 80% strain, and an absolute value of a difference between the length direction average modulus at 80% strain and the width direction average modulus at 80% strain is less than 70 gf.

17. The interlock knit textile according to claim 16, wherein the filaments of the first yarn consist of polyester filaments, nylon filaments, regenerated cellulose filaments, or any combination thereof.

18. The interlock knit textile according to claim 16, wherein the first yarn has a linear mass density ranging from about 30 D to about 70 D, and the second yarn has a linear mass density ranging from about 60 D to about 80 D.

19. The interlock knit textile according to claim 16, wherein the second yarn consists of a single filament of an elastomeric material having a lower hysteresis than conventional elastane.

20. An article of apparel comprising the interlock knit textile according to claim 16.

* * * * *